US010522080B2

(12) United States Patent
Kishi et al.

(10) Patent No.: US 10,522,080 B2
(45) Date of Patent: Dec. 31, 2019

(54) DISPLAY APPARATUS AND DRIVING METHOD THEREFOR

(71) Applicant: Sharp Kabushiki Kaisha, Sakai, Osaka (JP)

(72) Inventors: Noritaka Kishi, Sakai (JP); Hiroyuki Furukawa, Sakai (JP); Katsuya Otoi, Sakai (JP); Kazuyoshi Yoshiyama, Sakai (JP); Tamotsu Sakai, Sakai (JP); Naoko Goto, Sakai (JP); Noboru Noguchi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 75 days.

(21) Appl. No.: 15/751,552

(22) PCT Filed: Aug. 3, 2016

(86) PCT No.: PCT/JP2016/072734

§ 371 (c)(1),
(2) Date: Feb. 9, 2018

(87) PCT Pub. No.: WO2017/026335

PCT Pub. Date: Feb. 16, 2017

(65) Prior Publication Data

US 2018/0233081 A1 Aug. 16, 2018

(30) Foreign Application Priority Data

Aug. 10, 2015 (JP) ..... 2015-157902

(51) Int. Cl.
*G09G 3/3233* (2016.01)

(52) U.S. Cl.
CPC ... *G09G 3/3233* (2013.01); *G09G 2320/0233* (2013.01); *G09G 2320/0285* (2013.01);
(Continued)

(58) Field of Classification Search
CPC ..... G09G 3/3233; G09G 2320/0693; G09G 2320/0233; G09G 2320/0285; G09G 2320/0295
See application file for complete search history.

(56) References Cited

U.S. PATENT DOCUMENTS 9,076,387 B1 * 7/2015 Lee ..... G09G 3/20
2009/0244047 A1 * 10/2009 Mizutani ..... G09G 3/325 345/211

(Continued)

FOREIGN PATENT DOCUMENTS

JP 2009-244654 A 10/2009
JP 2010-039407 A 2/2010
JP 2014-126873 A 7/2014

OTHER PUBLICATIONS

Official Communication issued in International Patent Application No. PCT/JP2016/072734, dated Nov. 1, 2016.

*Primary Examiner* — Md Saiful A Siddiqui
(74) *Attorney, Agent, or Firm* — Keating & Bennett, LLP

(57) ABSTRACT

In a data line drive/current measurement circuit, m measurement units are disposed in a plurality of semiconductor chips such that the m measurement units are distributed among the plurality of semiconductor chips. A display apparatus includes transistors such that one transistor is provided for two adjacent semiconductor chips. Inter-chip correction data indicating a variation among the semiconductor chips in terms of characteristics of elements in the measurement units is determined based on a result of a current measurement performed for the same transistor using measurement units disposed in different semiconductor chips. The inter-chip correction data is stored in a storage unit and is used in correcting an image signal. The inter-chip correction data may be determined based on a result of measuring a current flowing through a common cathode of organic EL elements for each semiconductor chip. Thus, a variation in the characteristic of the element among the semiconductor chips is compensated for and high image quality is achieved in displaying.

10 Claims, 13 Drawing Sheets

(52) U.S. Cl.
CPC ..... *G09G 2320/0295* (2013.01); *G09G 2320/0693* (2013.01)

(56) References Cited

U.S. PATENT DOCUMENTS

| | | | |
|---|---|---|---|
| 2010/0033410 | A1 | 2/2010 | Ishii et al. |
| 2014/0176622 | A1 | 6/2014 | Jung et al. |

* cited by examiner

DISPLAY APPARATUS AND DRIVING METHOD THEREFOR

The present disclosure relates to a display apparatus, and more particularly, to a display apparatus including a pixel circuit including an electro-optic element such as an organic EL element, and to a driving method therefor.

TECHNICAL FIELD

The present invention relates to a display apparatus, and more particularly, to a display apparatus including a pixel circuit including an electro-optic element such as an organic EL element, and to a driving method therefor.

BACKGROUND ART

In recent years, an organic EL (Electro Luminescence) display apparatus has attracted because of its small thickness, light weight, and high response speed. The organic EL display apparatus includes a plurality of pixel circuits arranged in a two-dimensional form. The pixel circuits of the organic EL display apparatus each include an organic EL element and a driving transistor connected in series to the organic EL element. The driving transistor controls the amount of a current flowing through the organic EL element, and the organic EL element emits light with luminance depending on the flowing current.

Variations in characteristics of elements in pixel circuits occur during a production process. Furthermore, the characteristics of elements in the pixel circuits change with passage of time. For example, characteristics of driving transistors degrade individually depending on light emission luminance or light emission time. As with the driving transistors, characteristics of organic EL elements also degrade. Therefore, even when there is no difference in voltage applied to gate terminals of driving transistors, a variation occurs in light emission luminance among organic EL elements.

In view of the above, to achieve high image quality in displaying in organic EL display apparatuses, it is known, as a method, to correct an image signal so as to compensate for variations in characteristics among organic EL elements or driving transistors or as to compensate for changes in characteristic with time. For example, PTL 1 discloses an organic EL display apparatus configured such that voltages between terminals of organic EL elements, which occur when a calibration current is passed through each organic EL element, are measured, and an image signal is corrected based on the measured voltages thereby compensating for characteristic changes of the organic EL elements.

CITATION LIST

Patent Literature

PTL 1: Japanese Unexamined Patent Application Publication No. 2009-244654

SUMMARY

Technical Problem

However, variations of characteristics of elements also occur outside pixel circuits. Hereinafter, a discussion is given as to an organic EL display apparatus in which, to compensate for variations or changes in characteristics of elements in pixel circuits, current measurement circuits configured to measure currents flowing through pixel circuits are provided. In a case where a current measurement circuit including an operational amplifier and a capacitor is used, a variation of capacitance of the capacitor occurs due to a variation in a semiconductor process used to form the current measurement circuit. Furthermore, in an organic EL display apparatus including a plurality of current measurement circuits, a plurality of semiconductor chips each including one or more current measurement circuits are provided. In this case, the variation of capacitance of capacitors disposed in different semiconductor chips is greater than the variation of capacitors disposed in the same semiconductor chip.

When there is a variation in capacitance of capacitors in current measurement circuits, it is impossible to accurately measure a current flowing in each pixel circuit, and thus it is impossible to accurately correct an image signal such that the variation or the change in the characteristics of elements in the pixel circuits is compensated for. Therefore, in the organic EL display apparatus, even if the image signal is corrected based on a result of the current measurement, variations of characteristics of elements among semiconductor chips may cause a luminance difference to occur at a boundary between areas, which may make it difficult to achieve high image quality in displaying. Furthermore, there is a possibility that a variation of characteristics of an element among current measurement circuits may make it difficult to achieve high image quality in displaying.

Thus, it is an object of the present disclosure to provide a display apparatus configured to compensate for a variation in terms of a characteristic of an element among semiconductor chips thereby achieving high image quality in displaying. It is another object of the present disclosure to provide a display apparatus configured to compensate for a variation in terms of a characteristics of an element among measurement units thereby achieving high image quality in displaying.

Solution to Problem

In a first aspect of the present invention, an active matrix display apparatus includes a display unit including a plurality of scanning lines, a plurality of data lines, and a plurality of pixel circuits arranged in a two-dimensional form, a scanning line drive circuit configured to drive the scanning lines, a data line drive circuit configured to drive the data lines, a measurement circuit including a plurality of measurement units and configured to measure currents or voltages of the pixel circuits, a correction unit configured to correct, based on the currents or the voltages measured by the measurement circuit, an image signal to be supplied to the data line drive circuit, and a storage unit configured to store data used in correcting the image signal, the plurality of measurement units being disposed in a plurality of semiconductor chips such that the plurality of measurement units are distributed among the plurality of semiconductor chips, the storage unit being configured to store inter-chip correction data indicating a variation in terms of a characteristic of an element in the measurement unit among the semiconductor chips.

In a second aspect of the present invention according to the first aspect of the present invention, the inter-chip correction data is data based on a result of a measurement of a current or a voltage, the measurement being performed for the same measurement target circuit using measurement units disposed in different semiconductor chips.

In a third aspect of the present invention according to the second aspect of the present invention, the semiconductor chips are arranged in a one-dimensional form, and the measurement target circuit is further provided for two adjacent semiconductor chips.

In a fourth aspect of the present invention according to the second aspect of the present invention, the number of measurement target circuits is smaller by one than the number of semiconductor chips.

In a fifth aspect of the present invention according to the first aspect of the present invention, the pixel circuits each include an electro-optic element including a common cathode, and the inter-chip correction data is data based on a result of measurement of a current flowing through the common cathode for each semiconductor chip.

In a sixth aspect of the present invention according to the fifth aspect of the present invention, the inter-chip correction data is data based on a result of a measurement of a current flowing through the common cathode, the measurement being performed for each of a plurality of areas into which the display unit is divided such that the areas correspond to the respective semiconductor chips, the measurement being performed while controlling light emission to sequentially occur from one area to another in the display unit.

In a seventh aspect of the present invention according to the first aspect of the invention, the storage unit further stores inter-channel correction data indicating a variation in terms of a characteristic of an element included in one measurement unit among the measurement units.

In an eighth aspect of the present invention according to the seventh aspect of the present invention, the inter-channel correction data is data based on a result of measuring a zero-current by using the correction unit.

In a ninth aspect of the present invention according to the first aspect of the present invention, the pixel circuit includes an electro-optic element and a driving transistor connected in series to the electro-optic element.

In a tenth aspect of the present invention according to the ninth aspect of the present invention, the storage unit further stores threshold voltages and gains of the electro-optic element and the driving transistor for each pixel circuit, and the correction unit determines, based on the currents or the voltages measured by the measurement circuit, the threshold voltages and the gains to be stored in the storage unit and corrects the image signal based on the threshold voltages and the gains stored in the storage unit.

In an eleventh aspect of the present invention according to the tenth aspect of the present invention, the pixel circuit further includes a write control transistor including a first conduction terminal connected to the data line, a second conduction terminal of a control terminal of the driving transistor, and a control terminal connected to a first scanning lines of the scanning lines, and a read control transistor including a first conduction terminal connected to the data line, a second conduction terminal connected to a connection node between the driving transistor and the electro-optic element, and a control terminal connected to a second scanning line of the scanning lines.

In a twelfth aspect of the present invention, a method of driving a display apparatus, the display apparatus being an active matrix display apparatus including a display unit including a plurality of scanning lines, a plurality of data lines, and a plurality of pixel circuits arranged in a two-dimensional form, the method includes driving the scanning lines, driving the data lines, measuring currents or voltages of the pixel circuits by using a plurality of measurement units, correcting, based on the measured currents or voltages, an image signal used to drive the data lines, and storing data used in correcting the image signal, the plurality of measurement units being disposed in a plurality of semiconductor chips such that the plurality of measurement units are distributed among the plurality of semiconductor chips, in the storing, inter-chip correction data indicating a variation of a characteristic of an element in the measurement unit among the semiconductor chips is stored.

In a thirteenth aspect of the present invention according to the twelfth aspect of the present invention, in the storing, inter-channel correction data indicating a variation of a characteristic of an element in the measurement unit among the measurement units is further stored.

Advantageous Effects of Disclosure

According to the first or twelfth aspect of the present invention, by storing the inter-chip correction data indicating the variation of the characteristic of the element in the measurement unit among the semiconductor chips and correcting the image signal using the stored inter-chip correction data, it is possible to compensate for the variation of the characteristic of the element among the semiconductor chips thereby achieving high image quality in displaying.

According to the second aspect of the present invention, based on the result of measuring currents or voltages of the same measurement target circuit by using measurement units disposed in different semiconductor chips, it is possible to determine the inter-chip correction data indicating the variation of the characteristic of the element in the measurement unit among the semiconductor chips.

According to the third or fourth aspect of the present invention, one measurement target circuit is provided for two adjacent semiconductor chips, and the current of the voltage is measured for the same measurement target circuit by using measurement units disposed in different semiconductor chip, and thereby it is possible to determine the inter-chip correction data.

According to the fifth aspect of the present invention, based on the result of measuring the current flowing through the common cathode for each semiconductor chip, it is possible to determine inter-chip correction data indicating the variation of the characteristic of the element among the semiconductor chips.

According to the sixth aspect of the present invention, it is possible to determine inter-chip correction data based on the result of measuring the current flowing through the common cathode while controlling light emission to occur sequentially in the areas of the display unit.

According to the seventh or thirteenth aspect of the present invention, by further storing inter-channel correction data indicating the variation of the characteristic of the element in one measurement unit among the measurement units and correcting the image signal using the stored inter-channel correction data, it is possible to compensate for the variation of the characteristic among the measurement units thereby achieving high image quality in displaying.

According to the eighth aspect of the present invention, it is possible to determine the inter-channel correction data based on the result of measuring the zero-current by using the correction unit.

According to the ninth aspect of the present invention, in the display apparatus including pixel circuits each including an electro-optic element and a driving transistor, it is possible to compensate for variations of characteristics of the elements among the semiconductor chips thereby achieving high image quality in displaying.

According to the tenth aspect of the present invention, by determining the threshold voltages and the gains of the electro-optic element and the driving transistor based on the result of measuring the currents or the voltages and correcting the image signal using these threshold voltages and the gains, it is possible to compensate for the variations or change of the characteristics of the electro-optic element and the driving transistor thereby achieving high image quality in displaying.

According to the eleventh aspect of the present invention, in the display apparatus including pixel circuits each including an electro-optic element, a driving transistor, a write control transistor, and a read control transistor, it is possible to compensate for variations of characteristics of elements among semiconductor chips thereby achieving high image quality in displaying.

DESCRIPTION OF EMBODIMENTS

Display apparatuses according to embodiments of the present invention are described below with reference to drawings. The display apparatuses according to the embodiments of the present invention are each an active matrix organic EL display apparatus including pixel circuits each including an organic EL element and a driving transistor. Hereinafter, a thin film transistor will also be referred to as a TFT (Thin Film Transistor) and an organic EL element will also be referred to as an OLED (Organic Light Emitting Diode). Furthermore, m, n, and p are each an integer equal to or greater than 2, i is an integer in a range from 1 (inclusive) to n (inclusive), and j is an integer in a range from 1 (inclusive) to m (inclusive).

First Embodiment

Figure 1:
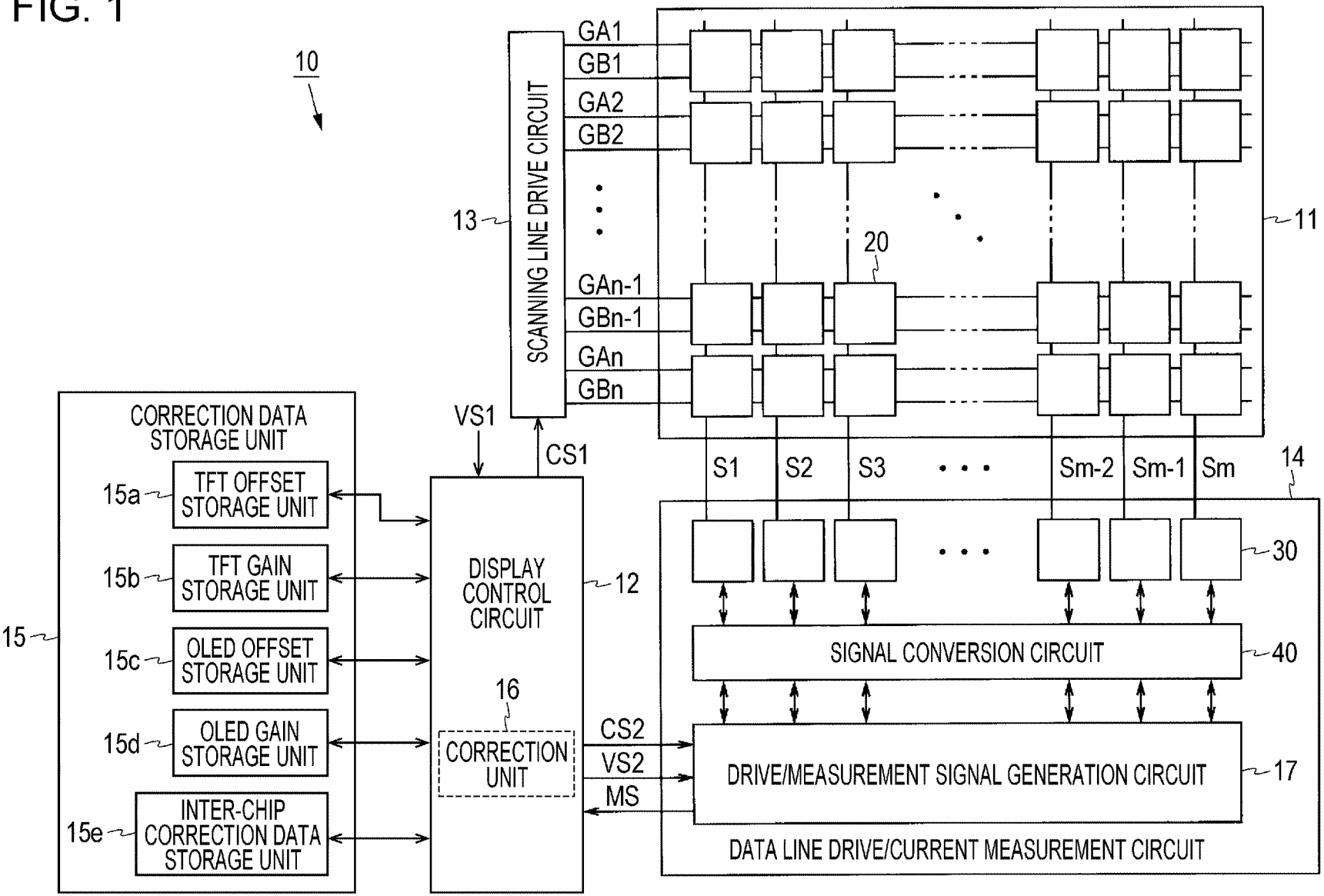
FIG. 1 is a block diagram illustrating a configuration of a display apparatus according to a first embodiment of the present invention.

FIG. 1 is a block diagram illustrating a configuration of a display apparatus according to a first embodiment of the present invention. The display apparatus 10 illustrated in FIG. 1 includes a display unit 11, a display control circuit 12, a scanning line drive circuit 13, a data line drive/current measurement circuit (a circuit functioning as both a data line drive circuit and a current measurement circuit) 14, and a correction data storage unit 15. The display control circuit 12 includes a correction unit 16.

The display unit 11 includes 2n scanning lines GA1 to GAn and GB1 to GBn, m data lines S1 to Sm, and (m×n) pixel circuits 20. The scanning lines GA1 to GAn and GB1 to GBn are disposed in parallel to each other. The data lines S1 to Sm are in parallel to each other and orthogonally to the scanning lines GA1 to GAn and GB1 to GBn. The scanning lines GA1 to GAn and the data lines S1 to Sm intersect each other at (m×n) points. (m×n) pixel circuits 20 are disposed at locations corresponding to the respective intersections between the scanning lines GA1 to GAn and the data lines S1 to Sm. Each pixel circuit 20 is supplied with a high-level power supply voltage ELVDD and a low-level power supply voltage ELVSS through a not-illustrated power supply line or a power supply electrode.

The display apparatus 10 is applied with an image signal VS1 from outside. Based on the image signal VS1, the display control circuit 12 outputs a control signal CS1 to the scanning line drive circuit 13 and outputs a control signal CS2 and an image signal VS2 to the data line drive/current measurement circuit 14. The control signal CS1 includes, for example, a gate start pulse and a gate clock. The control signal CS2 includes, for example, a source start pulse and a source clock. The image signal VS2 is obtained as a result of a correction performed by the correction unit 16 on the image signal VS1 as described later.

The scanning line drive circuit 13 and the data line drive/current measurement circuit 14 are disposed outside the display unit 11. The scanning line drive circuit 13 and the data line drive/current measurement circuit 14 perform, selectively, a process of writing a data voltage according to the image signal VS2 into the pixel circuits 20 and a process of measuring currents flowing through the pixel circuits 20 when a measurement voltage is written into the pixel circuits 20. Hereinafter, the former process is referred to "writing" and the latter process is referred to as "current measurement".

The scanning line drive circuit 13 drives the scanning lines GA1 to GAn and GB1 to GBn according to the control signal CS1. In the writing, the scanning line drive circuit 13 sequentially selects one scanning line from the scanning lines GA1 to GAn and applies a selection voltage (a high-level voltage in the present case) to the selected scanning line. As a result, m pixel circuits 20 connected to the selected scanning line are selected at a time.

The data line drive/current measurement circuit 14 includes a drive/measurement signal generation circuit (a circuit configured to generate a drive signal and a measurement signal) 17, a signal conversion circuit 40, and m output/measurement circuits (circuits each functioning as both an output circuit and measurement circuit) 30 and is configured to drive the data lines S1 to Sm according to the control signal CS2. In the writing, the data line drive/current measurement circuit 14 applies m data voltages according to the image signal VS2 to the respective data lines S1 to Sm. As a result, m data voltages are respectively written into the selected m pixel circuits 20.

Operations of the scanning line drive circuit 13 and the data line drive/current measurement circuit 14 in the current measurement will be described later. The data line drive/current measurement circuit 14 outputs a monitor signal MS, including a result of the measurement of the currents flowing through the pixel circuits 20, to the display control circuit 12.

The correction unit 16 determines, based on the monitor signal MS, characteristics of the driving transistors and the organic EL elements in the pixel circuits 20, and determines the image signal VS2 by correcting the image signal VS1 using the determined characteristics. The correction data storage unit 15 is a work memory for use by the correction unit 16. The correction data storage unit 15 includes a TFT offset storage unit 15*a*, a TFT gain storage unit 15*b*, an OLED offset storage unit 15*c*, an OLED gain storage unit 15*d*, and an inter-chip correction data storage unit 15*e*. The TFT offset storage unit 15*a* stores the threshold voltage of the driving transistor for each pixel circuit 20. The TFT gain storage unit 15*b* stores the gain of the driving transistor for each pixel circuit 20. The OLED offset storage unit 15*c* stores the threshold voltage of the organic EL element for each pixel circuit 20. The OLED gain storage unit 15*d* stores a gain of the organic EL element for each pixel circuit 20. The inter-chip correction data storage unit 15*e* stores data for use in compensating for a variation of a characteristic of an element (more specifically, capacitance of a capacitor) in a current measurement circuit among semiconductor chips.

Figure 2:
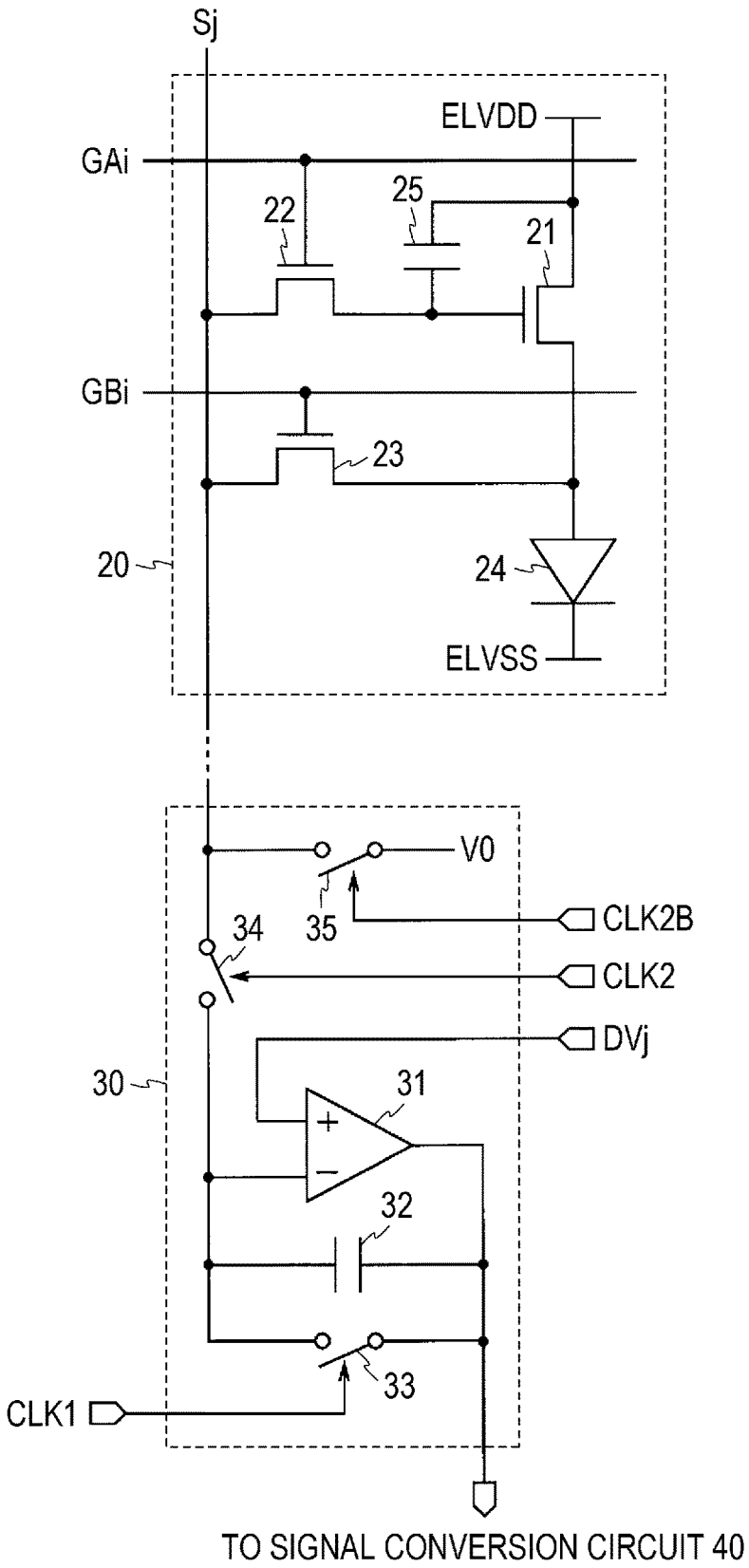
FIG. 2 is a circuit diagram of a pixel circuit and an output/measurement circuit of the display apparatus illustrated in FIG. 1.

FIG. 2 is a circuit diagram of a pixel circuit 20 and an output/measurement circuit 30. In FIG. 2, a pixel circuit 20 located in an ith row and a jth column and an output/measurement circuit 30 corresponding to a data line Sj are described. As illustrated in FIG. 2, the pixel circuit 20 located in the ith row and the jth column includes transistors 21 to 23, an organic EL element 24, and a capacitor 25 and is connected to scanning lines GAi and GBi and the data line Sj. The transistors 21 to 23 are each an N-channel type TFT.

A drain terminal of the transistor 21 is applied with a high-level power supply voltage ELVDD. A source terminal of the transistor 21 is connected to an anode terminal of the organic EL element 24. A cathode terminal of the organic EL element 24 is applied with a low-level power supply voltage ELVSS. One of conduction terminals (a terminal located on the left side in the case illustrated in FIG. 2) of each of the respective transistors 22 and 23 is connected to the data line Sj. The other conduction terminal of the transistor 22 is connected to a gate terminal of the transistor 21. A gate terminal of the transistor 22 is connected to a scanning line GAi. The other conduction terminal of the transistor 23 is connected to the source terminal of the transistor 21 and the anode terminal of the organic EL element 24. A gate terminal of the transistor 23 is connected to a scanning line GBi. The capacitor 25 is provided between a gate terminal of the transistor 21 and the drain terminal of the transistor 21. The transistors 21 to 23 respectively function as a driving transistor, a write control transistor, and a read control transistor.

The output/measurement circuit 30 corresponding to the data line Sj includes an operational amplifier 31, a capacitor 32, and switches 33 to 35, and is connected to the data line Sj. One end (an upper end in the case illustrated in FIG. 2) of the switch 34 and one end (a left-hand end in the case illustrated in FIG. 2) of the switch 35 are connected to the data line Sj. The other end of the switch 35 is applied with a particular voltage V0. A non-inverting input terminal of the operational amplifier 31 is applied with an output signal DVj output from a D/A converter (not illustrated) corresponding to the data line Sj. An inverting input terminal of the operational amplifier 31 is connected to the other end of the switch 34. The capacitor 32 is provided between the inverting input terminal of the operational amplifier 31 and an output terminal of the operational amplifier 31. The switch 33 is provided in parallel with the capacitor 32 between the inverting input terminal of the operational amplifier 31 and the output terminal of the operational amplifier 31. The switches 33 to 35 respectively turn on when switch control signals CLK1, CLK2, and CLK2B are at a high level. The switch control signal CLK2B is an inverted signal of the switch control signal CLK2.

Figure 3:
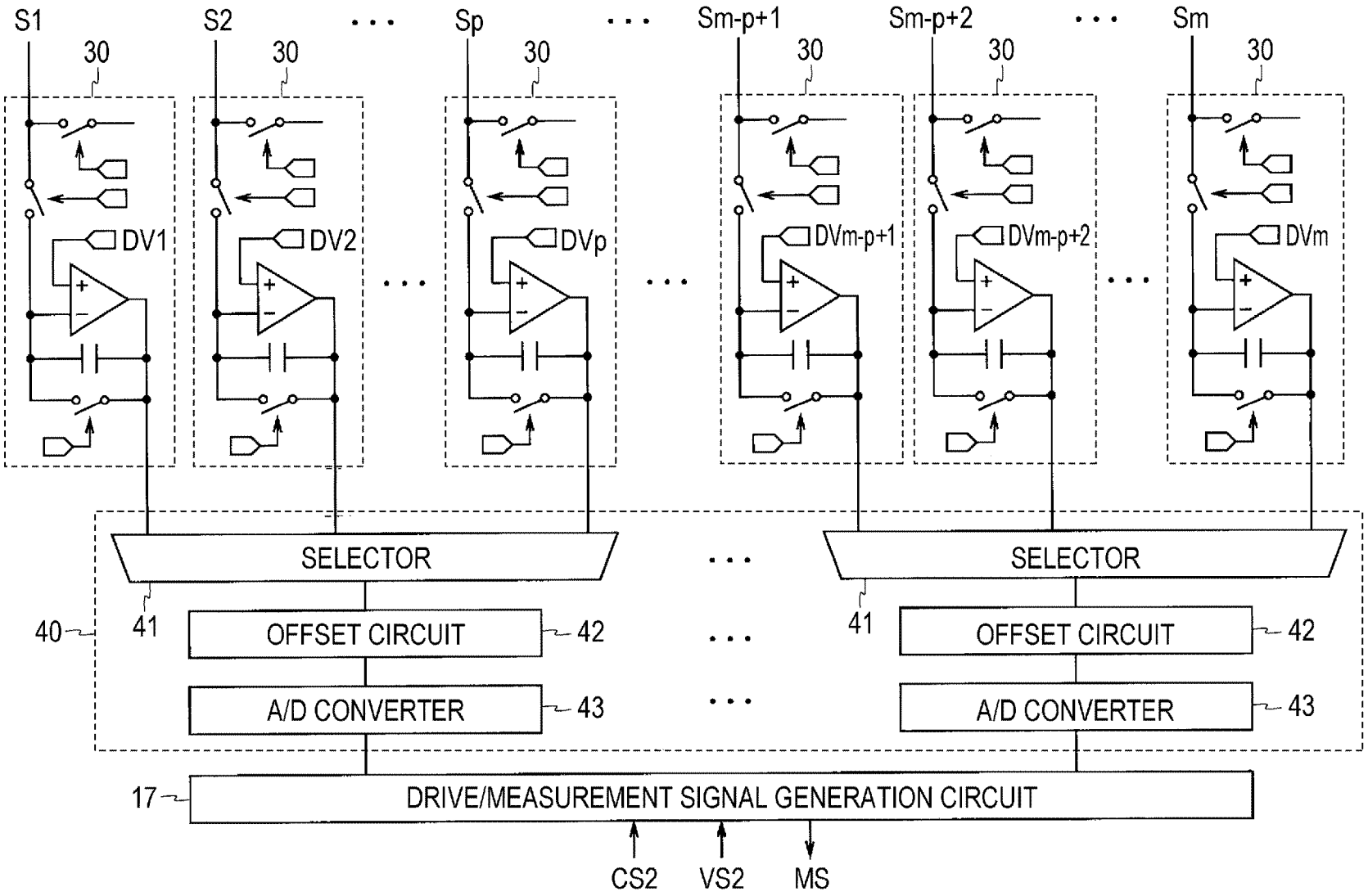
FIG. 3 is a diagram illustrating details of a part of a data line drive/current measurement circuit of the display apparatus illustrated in FIG. 1.

FIG. 3 is a diagram illustrating details of a part of the data line drive/current measurement circuit 14. As illustrated in FIG. 3, m output/measurement circuits 30 are respectively provided for m data lines S1 to Sm. The data lines S1 to Sm are grouped into (m/p) groups each including p data lines. The signal conversion circuit 40 includes (m/p) selectors 41, (m/p) offset circuits 42, and (m/p) A/D converters 43. One selector 41, one offset circuit 42, and one A/D converter 43 are provided for each data line group. At a location upstream of each selector 41, p output/measurement circuits 30 are provided. At a location downstream of the (m/p) A/D converters 43, a drive/measurement signal generation circuit 17 is provided.

The selector 41 is connected to output terminals of p output/measurement circuits 30 (output terminals of the operational amplifiers 31). The selector 41 selects one analog signal from output signals output from p output/measurement circuits 30. The offset circuit 42 adds a particular offset to the analog signal selected by the selector 41. The A/D converter 43 converts the analog signal output from the offset circuit 42 to a digital value. The drive/measurement signal generation circuit 17 temporarily stores the digital values determined by the (m/p) A/D converters 43. Each selector 41 sequentially selects output signals of p operational amplifiers 31. When the selector 41 has completed the selection p times, a total of m digital values are stored in the drive/measurement signal generation circuit 17. The drive/measurement signal generation circuit 17 outputs monitor signal MS including m digital values to the display control circuit 12.

To correct the image signal VS1 thereby obtaining the image signal VS2, the data line drive/current measurement circuit 14 measures four kinds of currents for each pixel circuit 20. More specifically, to determine the characteristic of the transistor 21 in each pixel circuit 20, the data line drive/current measurement circuit 14 measures a current Im1 that flows out of the pixel circuit 20 when a first measurement voltage Vm1 is written in the pixel circuit 20 and a current Im2 that flows out of the pixel circuit 20 when a second measurement voltage Vm2 (>Vm1) is written in the pixel circuit 20. Furthermore, to determine the characteristic of the organic EL element 24 in each pixel circuit 20, the data line drive/current measurement circuit 14 measures a current Im3 that flows into the pixel circuit 20 when a third measurement voltage Vm3 is written in the pixel circuit 20 and a current Im4 that flows into the pixel circuit 20 when a fourth measurement voltage Vm4 (>Vm3) is written in the pixel circuit 20. Hereinafter, an operation in which the currents Im1 and Im2 are measured is referred to as an "operation of detecting the driving transistor characteristic" while an operation in which the currents Im3 and Im4 are measured is referred to as an "operation of detecting the organic EL element".

The scanning line drive circuit 13 and the data line drive/current measurement circuit 14 perform a writing process on one row of pixel circuits 20 and a process of measuring one or four kinds of currents Im1 to Im4 for the one pixel circuits 20. The scanning line drive circuit 13 and the data line drive/current measurement circuit 14 may perform the current measurement when displaying is not performed or may perform the current measurement when displaying is being performed. An example of a method of performing the current measuring when displaying is being performed is to provide one or more long line periods longer than a normal line period in one frame period and measure currents of one row of pixel circuits in the one or more long line periods. Another example of a method is to measure currents of one or more rows of pixel circuits in a vertical blanking period in one frame period. In the following description, an explanation is given for a case where currents are measured for one row of pixel circuits in a vertical blanking period.

Figure 4:
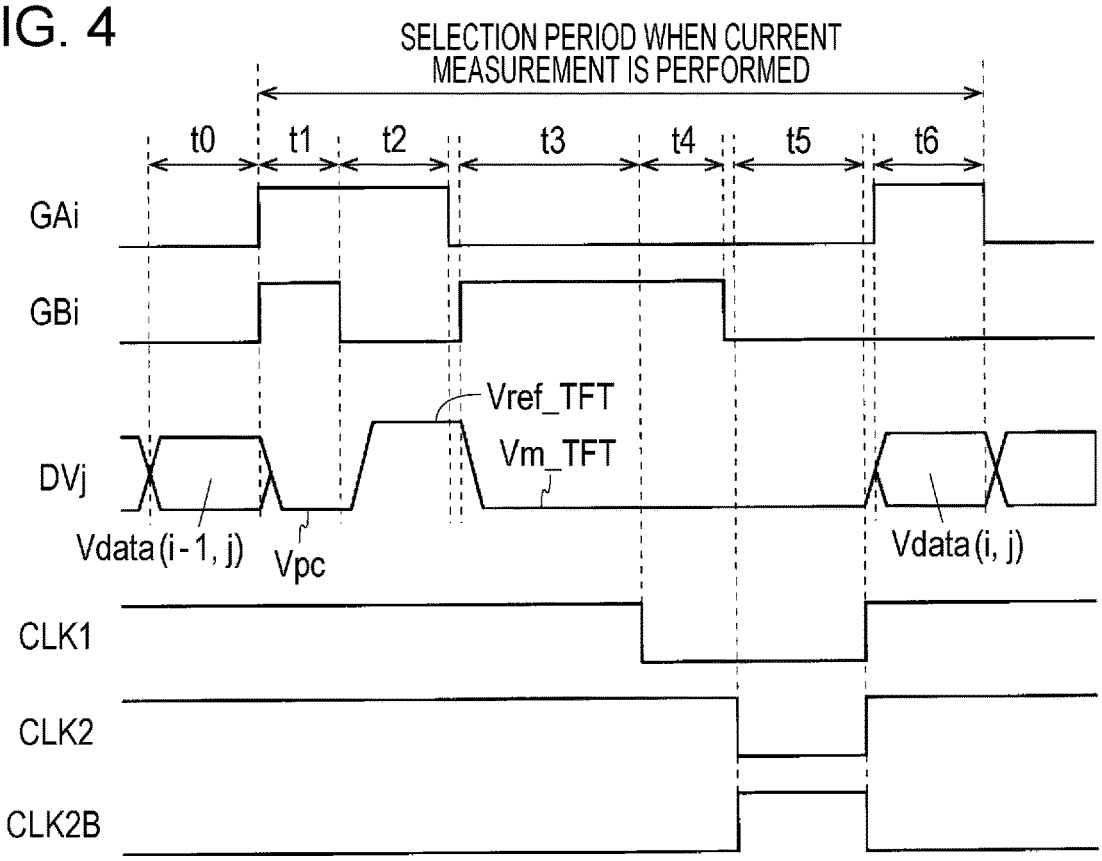
FIG. 4 is a timing chart associated with an operation of detecting a characteristic of a driving transistor in the display apparatus illustrated in FIG. 1.
Figure 5:
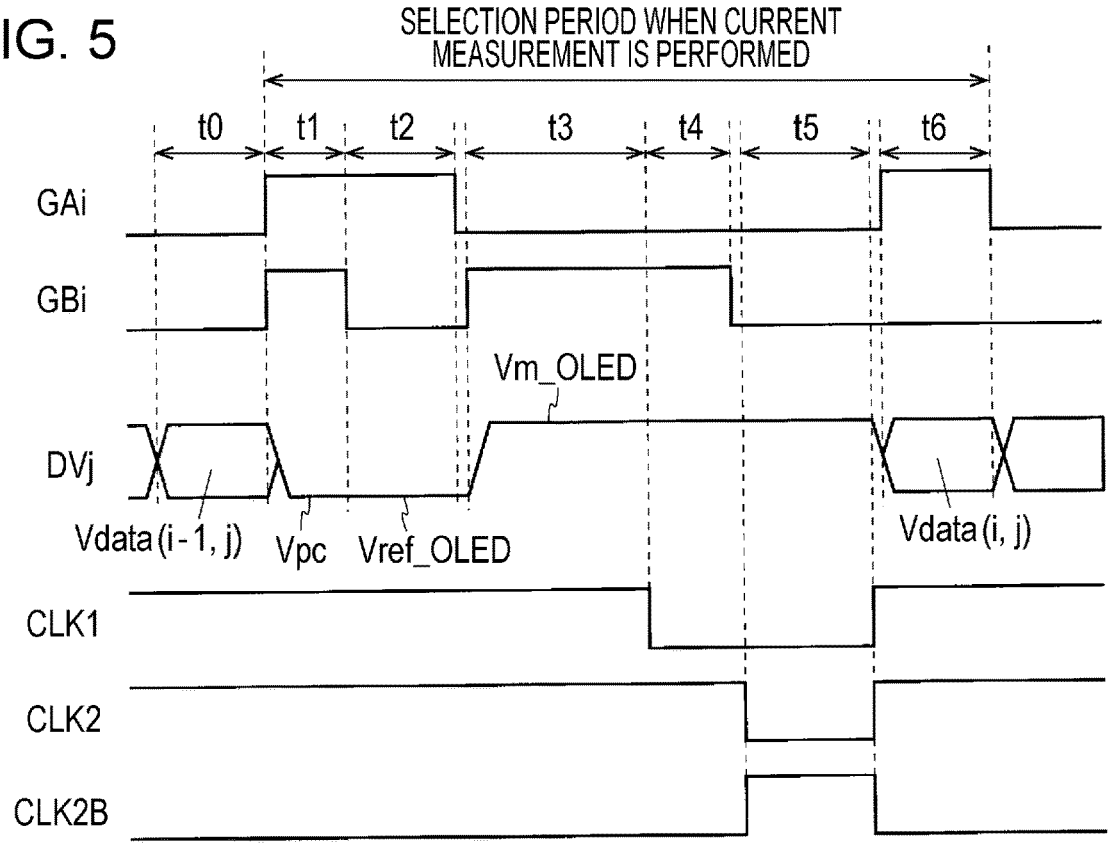
FIG. 5 is a timing chart associated with an operation of detecting a characteristic of an organic EL element in the display apparatus illustrated in FIG. 1.

FIG. 4 is a timing chart associated with an operation of detecting the driving transistor characteristic. FIG. 5 is a timing chart associated with an operation of detecting the organic EL element characteristic. In FIG. 4 and FIG. 5, a period t0 is a selection period in which writing in pixel circuits 20 in an (i−1)th row is performed. Periods t1 to t6 are selection periods in which current measurement is performed for pixel circuits 20 in an ith row. The selection periods in which the current measurement is performed include a reset period t1, a reference voltage writing period t2, a measurement voltage writing period t3, a current measurement period t4, an A/D conversion period t5, and a data voltage writing period t6. Hereinafter, signals on scanning lines GAi and GBi are denoted as scanning signals GAi and GBi, and a voltage of an output signal output from a D/A converter corresponding to a data line Sj is denoted by DVj.

Before the period t1, the scanning signals GAi and GBi and the switch control signals CLK2B are at the low level, while the switch control signals CLK1 and CLK2 are at the high level. During the period t0, a scanning signal GAi−1 (not illustrated) is at the high level, a scanning signal GBi−1 (not illustrated) is at the low level, and the voltage DVj is equal to a data voltage Vdata(i−1, j) to be written into a pixel circuit 20 in an (i−1)th row and in a jth column.

In a period t1, the scanning signals GAi and GBi are at the high level, and the voltage DVj is equal to a precharge voltage Vpc. The precharge voltage Vpc is determined such that the transistor 21 turns off. In particular, it is preferable to determine the precharge voltage Vpc to be as high as possible within a range in which the driving transistor (the transistor 21) and the organic EL element 24 both turn off. In the period t1, in the pixel circuits 20 in the ith row, the transistors 22 and 23 turn on, and the precharge voltage Vpc is applied to the gate terminal and the source terminal of the transistor 21 and also to the anode terminal of the organic EL element 24. As a result, the transistor 21 and the organic EL element 24 in the pixel circuit 20 in the ith row are initialized.

For example, in a case where the transistor 21 is formed using oxide semiconductor such as InGaZnO (Indium Gallium Zinc Oxide), there is a possibility that the transistor 21 has a hysteresis characteristic. In such a situation, if the transistor 21 is used without being initialized, there is a possibility that a current measurement result varies depending on an immediately previous display state. By providing the reset period t1 at the beginning in the selection period in the current measurement and initializing the transistor 21 in the reset period t1, it is possible to prevent an occurrence of a variation in the current measurement result due to the hysteresis characteristic. Note that the organic EL element 24 does not have a hysteresis characteristic, and thus it is not necessary to provide a reset period t1 in the operation of detecting the organic EL element characteristic. On the other hand, in a case in which currents are measured not when displaying is being performed but currents are measured in a situation in which displaying is not performed immediately after power is turned on or when displaying is disabled, it is allowed not to provide the reset period.

In the period t2, the scanning signal GAi is at the high level, the scanning signal GBi is at the low level, and the voltage DVj is equal to the reference voltage (which is set to Vref_TFT in the operation of detecting the driving transistor characteristic, and to Vref_OLED in the operation of detecting the organic EL element characteristic). In the period t2, in the pixel circuit 20 in the ith row and the jth column, the transistor 22 turns on, the transistor 23 turn off, and the gate terminal of the transistor 21 is applied with the reference voltage Vref_TFT or Vref_OLED. The reference voltage Vref_TFT is determined to be a high voltage such that the transistor 21 turns on in the periods t3 and t4. The reference voltage Vref_OLED is determined to be a low voltage such that the transistor 21 turns off in the periods t3 and t4.

In the period t3, the scanning signal GAi is at the low level, the scanning signal GBi is at the high level, and the voltage DVj is given by one of the first to fourth measurement voltages Vm1 to Vm4. In FIG. 4, Vm_TFT denotes one of the first and second measurement voltages Vm1 and Vm2, while in FIG. 5, Vm_OLED denotes one of the third and fourth measurement voltages Vm3 and Vm4. In the period t3, in the pixel circuit 20 in the ith row and the jth column, the transistor 22 turn off, the transistor 23 turn on, and the anode terminal of the organic EL element 24 is applied with one of the first to fourth measurement voltages Vm1 to Vm4. During the operation of detecting the driving transistor characteristic, the transistor 21 turns on, and a current flows from a power supply line or a power supply electrode with a high-level power supply voltage ELVDD into the transistor 21 and then into the transistor 23 and, after passing through the transistors 21 and 23, into the data line Sj. During the operation of detecting the organic EL element characteristic, the transistor 21 turn off, and a current flows from the data line Sj into the transistor 23 and then into the organic EL element 24, and after passing through the transistor 23 and the organic EL element 24, into a power supply line or a power supply electrode with a low-level power supply voltage ELVSS. At a certain time after the start of the period t3, the data line Sj has been charged to a particular voltage level, and the magnitude of the current flowing out from the pixel circuit 20 into the data line Sj or the magnitude of the current flowing from the data line Sj into the pixel circuit 20) reaches a constant value.

Note that in the operation of detecting the driving transistor characteristic, if a source potential of the transistor 21 in the period t2 is low, this results in a large gate-to-source voltage of the transistor 21 at the beginning of the period t3, which causes a large current to flow through the transistor 21 and thus the organic EL element 24 emits light. Such light emission can be prevented, by determining the precharge voltage Vpc applied in the period t1 to be as high as possible within a range in which the driving transistor and the organic EL element 24 both turn off, as described above.

In the period t4, the scanning signals GAi and GBi and the voltage DVj maintain the same levels as those in the period t3, and the switch control signal CLK1 changes to the low level. In this period t4, the switch 33 turns off, and the output terminal and the inverting input terminal of the operational amplifier 31 are connected to each other via the capacitor 32. In this state, the operational amplifier 31 and the capacitor 32 function as an integrating amplifier. The output voltage of the operational amplifier 31 at the end of the period t4 is determined by the amount of a current flowing through the pixel circuit 20 in the ith row and in the jth column and the data line Sj, the capacitance of the capacitor 32, and the length of the period t4.

In the period t5, the scanning signals GAi and GBi and the switch control signals CLK1 and CLK2 are at the low level, and the switch control signal CLK2B changes to the high level, while the voltage DVj maintains the same level as that in the periods t3 and t4. In the period t5, in the pixel circuit 20 in the ith row and in the jth column, the transistors 22 and 23 turn off. Furthermore, the switch 34 turns off and the switch 35 turns on, and thus the data line Sj is electrically disconnected from the non-inverting input terminal of the operational amplifier 31, and the data line Sj is applied with a voltage V0. The electrical disconnection of the non-inverting input terminal of the operational amplifier 31 from the data line Sj causes the output voltage of the operational amplifier 31 to become constant. In the period t5, the offset circuit 42 corresponding to a group including the data line Sj adds an offset to the output voltage of the operational amplifier 31, and the A/D converter 43 corresponding to this group converts an analog signal, obtained as a result of the addition of the offset, to a digital value (see FIG. 3).

In the period t6, the scanning signal GAi is at the high level, the scanning signal GBi is at the low level, and the voltage DVj is given by the data voltage Vdata(i, j) to be written into the pixel circuit 20 in the ith row and the jth column. In this period t6, in the pixel circuit 20 in the ith row and the jth column, the transistor 22 turns on, and the gate terminal of the transistor 21 is applied with the data voltage Vdata(i, j). When the scanning signal GAi changes to the low level at the end of the period t6, the transistor 22 in the pixel circuit 20 in the ith row and the jth column turns off. After this, in the pixel circuit 20 in the ith row and the jth column, the gate voltage of the transistor 21 is maintained at Vdata(i, j) by the operation of the capacitor 25.

The correction unit 16 performs a process of determining the characteristics of the transistor 21 and the organic EL element 24 based on the measured four kinds of currents Im1 to Im4, and corrects the image signal VS1 based on the determined two kinds of characteristics. More specifically, the correction unit 16 determines the threshold voltage and the gain, as the characteristics, of the transistor 21 based on the two kinds of currents Im1 and Im2. The threshold voltage of the transistor 21 is written into the TFT offset storage unit 15*a*, and the gain of the transistor 21 is written into the TFT gain storage unit 15*b*. Furthermore, the correction unit 16 determines the threshold voltage and the gain, as the characteristics, of the organic EL element 24 based on the two kinds of currents Im3 and Im4. The threshold voltage of the organic EL element 24 is written into the OLED offset storage unit 15*c*, and the gain of the organic EL element 24 is written into the OLED gain storage unit 15*d*. The correction unit 16 reads out the threshold voltages and the gains from the correction data storage unit 15 and corrects the image signal VS1 using the threshold voltages and the gains.

Hereinafter, the gate-to-source voltage of the transistor 21 obtained when the first and second measurement voltages Vm1 and Vm2 are written into the pixel circuit 20 are respectively denoted by Vgsm1 and Vgsm2, and the anode-to-cathode voltage of the organic EL element 24 obtained when the third and fourth measurement voltages Vm3 and Vm4 are written into the pixel circuit 20 are respectively denoted by Vom3 and Vom4.

When the correction unit 16 receives the monitor signal MS including the currents Im1 and Im2, the correction unit 16 determines the threshold voltage $Vth_{TFT}$ and a gain $\beta_{TFT}$ of the transistor 21 by performing operations shown in formulae (1a) and (1b) on the voltages Vgsm1 and Vgsm2 and the currents Im1 and Im2.

[Math. 1]

$$Vth_{TFT} = \frac{Vgsm1\sqrt{Im2} - Vgsm2\sqrt{Im1}}{\sqrt{Im2} - \sqrt{Im1}} \tag{1a}$$

$$\beta_{TFT} = \frac{2\left(\sqrt{Im2} - \sqrt{Im1}\right)^2}{(Vgsm2 - Vgsm1)^2} \tag{1b}$$

The threshold voltage $Vth_{TFT}$ is written into the TFT offset storage unit 15*a*, and the gain $\beta_{TFT}$ is written into the TFT gain storage unit 15*b*.

When the correction unit 16 receives the monitor signal MS including the currents Im3 and Im4, the correction unit 16 determines the threshold voltage $Vth_{OLED}$ and a gain $\beta_{OLED}$ of the organic EL element 24 by performing operations shown in formulae (2a) and (2b) on the voltages Vom3 and Vom4 and the currents Im3 and Im4.

[Math. 2]

$$Vth_{OLED} = \frac{Vom3\sqrt[K]{Im4} - Vom4\sqrt[K]{Im3}}{\sqrt[K]{Im4} - \sqrt[K]{Im3}} \tag{2a}$$

-continued $$\beta_{OLED} = \frac{\left(\sqrt[K]{Im4} - \sqrt[K]{Im3}\right)^K}{(Vom4 - Vom3)^K} \tag{2b}$$

In formulae (2a) and (2b), K is a constant in a range from 2 (inclusive) to 3 (inclusive). The threshold voltage $Vth_{OLED}$ is written into the OLED offset storage unit 15*c*, and the gain $\beta_{OLED}$ is written into the OLED gain storage unit 15*d*.

Figure 6:
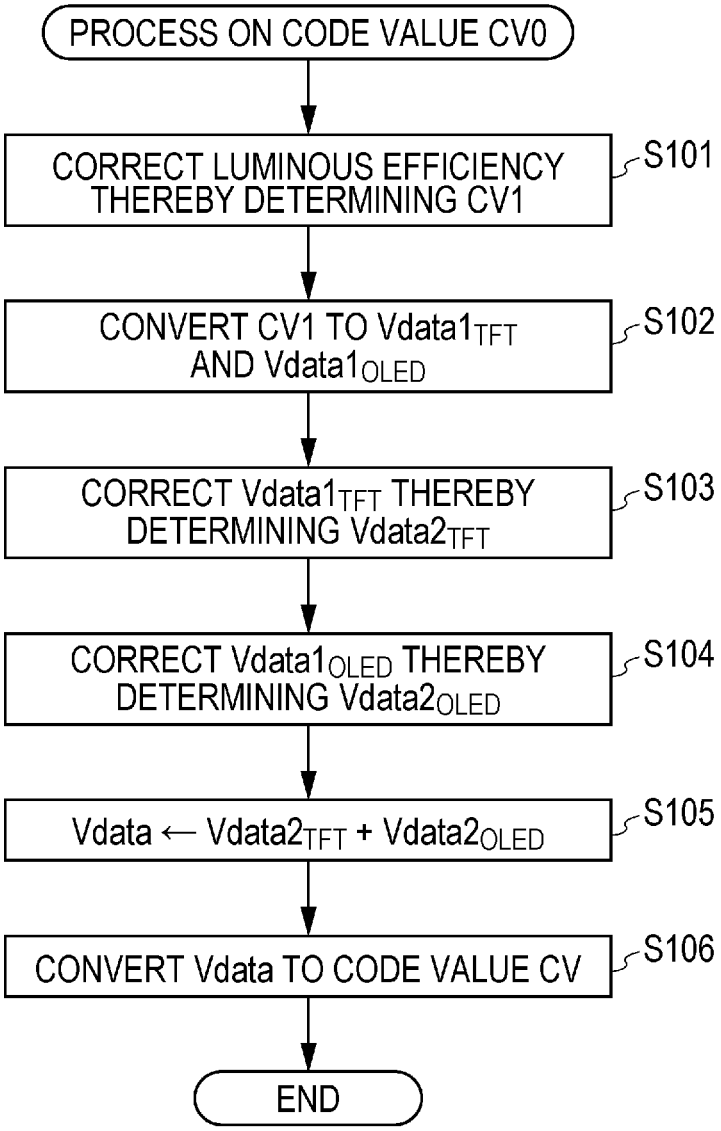
FIG. 6 is a flow chart illustrating a correction process in the display apparatus illustrated in FIG. 1.

FIG. 6 is a flow chart illustrating the correction process on the image signal VS1. The correction unit 16 corrects a code value CV0 included in the image signal VS1 by using the threshold voltage $Vth_{TFT}$ of the transistor 21, the gain $\beta_{TFT}$ of the transistor 21, the threshold voltage $Vth_{OLED}$ of the organic EL element 24, and the gain $\beta_{OLED}$ of the organic EL element 24. Note that the threshold voltages $Vth_{TFT}$ and $Vth_{OLED}$ and gains $\beta_{TFT}$ and $\beta_{OLED}$ used in the process described below are read out from the correction data storage unit 15.

First, the correction unit 16 performs a process of correcting the luminous efficiency of the organic EL element 24 (step S101). More specifically, the correction unit 16 determines the corrected code value CV1 by performing an operation described in formula (3).

$$CV1 = CV0 \times \gamma \tag{3}$$

Note that in formula (3), γ denotes a luminous efficiency correction factor determined for each pixel circuit 20. A greater value is given to the luminous efficiency correction factor γ for a pixel having greater degradation in the luminous efficiency of the organic EL element 24. Note that γ may also be determined by a calculation.

Next, the correction unit 16 converts the corrected code value CV1 to a voltage value $Vdata1_{TFT}$ indicating the gate-to-source voltage of the transistor 21 and a voltage value $Vdata1_{OLED}$ indicating the anode-to-cathode voltage of the organic EL element 24 (step S102). The conversion in step S102 is performed, for example, by a method in which a table prepared in advance is referred to or by a method in which an operation using an operational unit is performed.

Next, the correction unit 16 determines the corrected voltage value $Vdata2_{TFT}$ by performing a calculation on the voltage value $Vdata1_{TFT}$ according to formula (4) shown below (step S103).

$$Vdata2_{TFT} = Vdata1_{TFT} \times B_{TFT} + Vth_{TFT} \tag{4}$$

Note that $B_{TFT}$ included in formula (4) is given by formula (5) shown below where $\beta 0_{TFT}$ denotes an initial value of the gain of the transistor 21.

$$B_{TFT} = \sqrt{(\beta 0_{TFT}/\beta_{TFT})} \tag{5}$$

Next, the correction unit 16 determines the corrected voltage value $Vdata2_{OLED}$ by performing an operation on the voltage value $Vdata1_{OLED}$ according to formula (6) shown below (step S104).

$$Vdata2_{OLED} = Vdata1_{OLED} \times B_{OLED} + Vth_{OLED} \tag{6}$$

Note that $B_{OLED}$ included in formula (6) is given by formula (7) shown below where $\beta 0_{OLED}$ denotes an initial value of the gain of the organic EL element 24.

$$B_{OLED} = (\beta 0_{OLED}/\beta_{OLED})^{1/K} \tag{7}$$

Next, the correction unit 16 adds the corrected voltage value $Vdata2_{TFT}$ determined in step S103 and the corrected voltage value $Vdata2_{OLED}$ determined in step S104 according to formula (8) shown below. As a result, a voltage value Vdata indicating a voltage applied to the gate terminal of the transistor 21 is obtained (step S105).

$$Vdata = V2data_{TFT} + V2data_{OLED} \tag{8}$$

Finally, the correction unit 16 converts the voltage value Vdata to an output code value CV (step S106). The conversion in step S106 is performed in a similar manner to the conversion in step S102.

Hereinafter, in the output/measurement circuit 30 and the signal conversion circuit 40, a part that determines one digital value based on a current flowing through one data line is referred to as a channel. The data line drive/current measurement circuit 14 includes m channels corresponding to the respective m data lines S1 to Sm.

Figure 7:
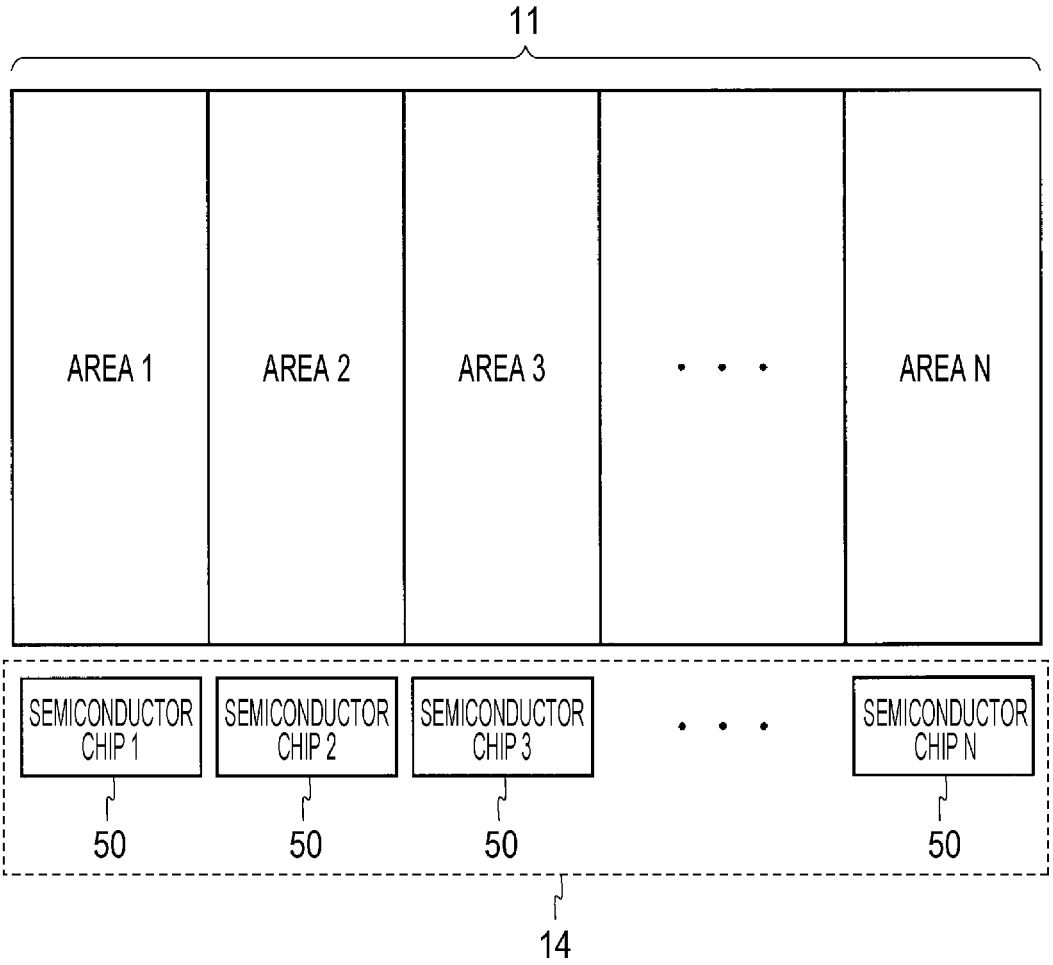
FIG. 7 is a diagram illustrating a configuration of a data line drive/current measurement circuit and illustrating a manner in which a display unit is divided into areas in the display apparatus illustrated in FIG. 1.

FIG. 7 is a diagram illustrating a configuration of the data line drive/current measurement circuit 14 and illustrating a manner in which the display unit 11 is divided into areas. As illustrated in FIG. 7, the data line drive/current measurement circuit 14 includes N semiconductor chips 50 (where N is an integer equal to or greater than 2). The m channels included in the data line drive/current measurement circuit 14 are distributed among the N semiconductor chips 50. The N semiconductor chips 50 are arranged along one side (a lower side in the case in FIG. 7) of the display unit 11. The display unit 11 are divided into N areas corresponding to the respective N semiconductor chips 50. Hereinafter, the respective N semiconductor chips 50 are referred to as 1st, 2nd, . . . , and Nth semiconductor chips as seen from left to right, and the N areas are referred to 1st, 2nd, . . . , and Nth areas as seen from left to right.

In the display apparatus 10, there is a possibility that a variation occurs in the capacitance of the capacitor 32 in the output/measurement circuit 30. In a case where the capacitance of the capacitor 32 has a variation, if the image signal VS1 is corrected without taking into account the variation, a difference in luminance may occur at a boundary between areas, and thus it is difficult to achieve high image quality in displaying. The variation of the capacitance is large among the capacitors 32 included in the same semiconductor chip 50, but the variation is large among capacitors 32 included in different semiconductor chips 50. In view of the above, in the display apparatus 10, the variation of the capacitance of the capacitor 32 among the semiconductor chips 50 is compensated for by a method described below.

Figure 8:
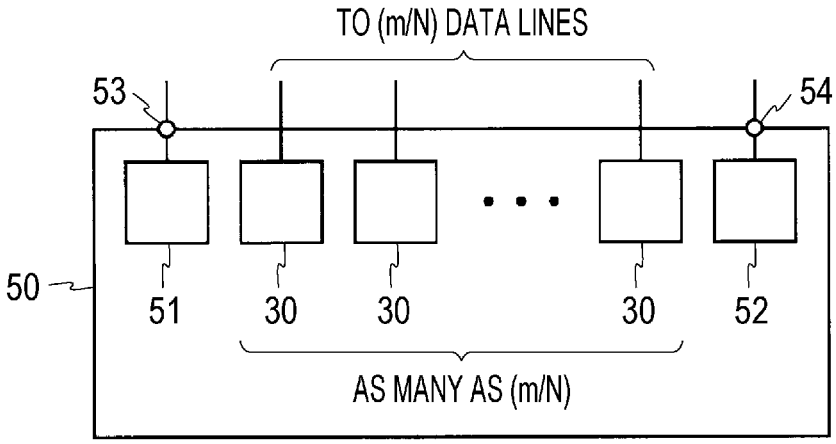
FIG. 8 is a diagram illustrating details of a semiconductor chip forming a data line drive/current measurement circuit of the display apparatus illustrated in FIG. 1.

FIG. 8 is a diagram illustrating details of one semiconductor chip 50. As illustrated in FIG. 8, the semiconductor chip 50 includes (m/N) output/measurement circuits 30, two calibration output/measurement circuits 51 and 52, and two external terminals 53 and 54. The (m/N) output/measurement circuits 30 are respectively connected to (m/N) data lines, and measure currents flowing through pixel circuits 20 in a corresponding area in the display unit 11. For example, the (m/N) output/measurement circuits 30 included in the 1st semiconductor chip 50 are respectively connected to data lines S1 to Sm/N, and measures currents flowing through pixel circuits 20 in the 1st area.

The calibration output/measurement circuits 51 and 52 are the same in circuit configuration as the output/measurement circuit 30. The external terminal 53 is disposed on one end (a left-hand end in the case illustrated in the figure) of the semiconductor chip 50 and is connected to the calibration output/measurement circuit 51. The external terminal 54 is disposed on the other end (a right-hand end in the case illustrated in the figure) of the semiconductor chip 50 and is connected to the calibration output/measurement circuit 52. A signal conversion circuit 40 is also provided at a location downstream of each of the calibration output/measurement circuits 51 and 52. The calibration output/measurement circuits 51 and 52 and the signal conversion circuit 40 form two channels.

The display apparatus 10 includes (N−1) measurement target circuits for the N semiconductor chips 50. As described below, one measurement target circuit is provided for each two adjacent semiconductor chips 50. By comparing a result of measurement performed by one of the two adjacent semiconductor chips 50 for a current flowing through a measurement target circuit with a result of measurement performed by the other one of the two adjacent semiconductor chips 50 for a current flowing through the measurement target circuit, it is possible to obtain inter-chip correction data indicating a variation of the characteristic of the element between the semiconductor chips 50. Furthermore, by correcting the image signal VS1 using the obtained inter-chip correction data, it is possible to compensate for the variation of the characteristic of the element among the semiconductor chips 50 thereby achieving high image quality in displaying.

Figure 9:
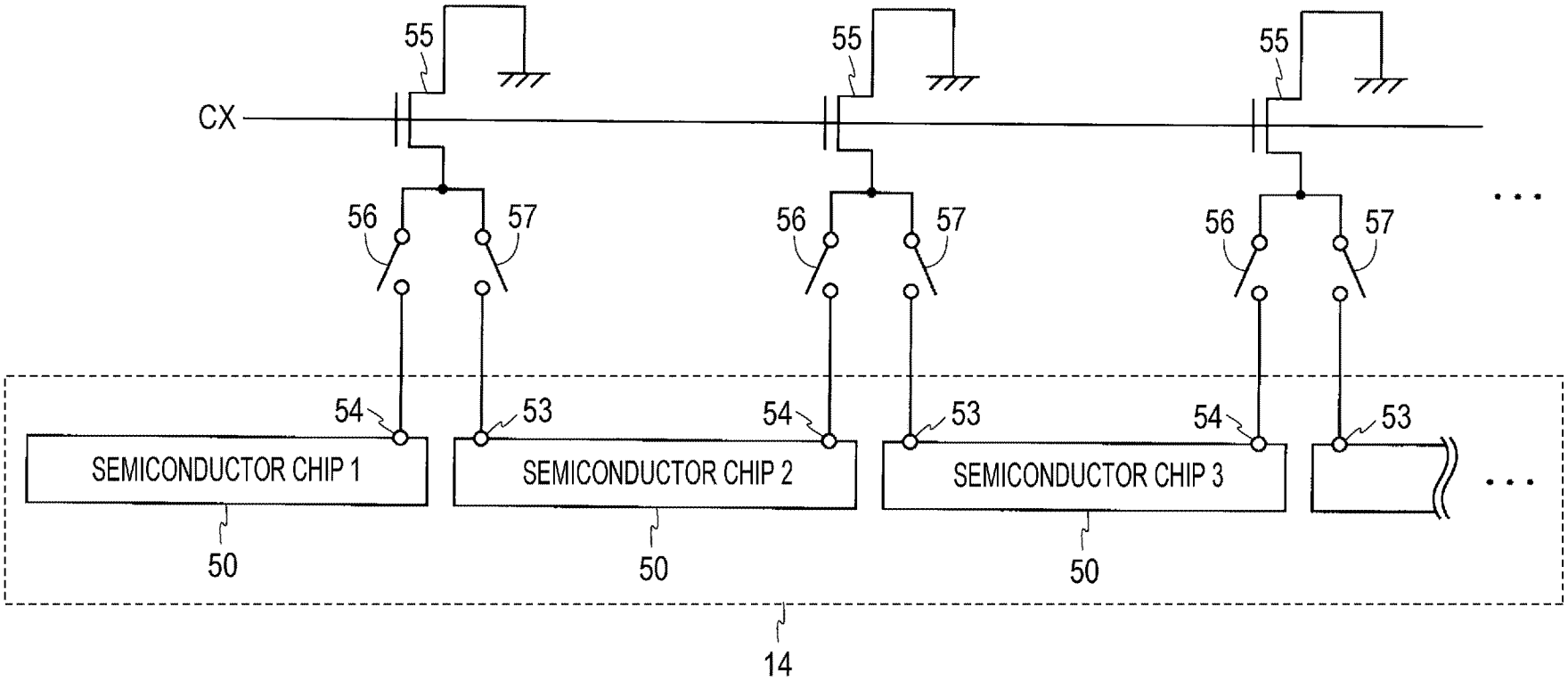
FIG. 9 is a circuit diagram of a measurement target circuit in the display apparatus illustrated in FIG. 1.

FIG. 9 is a circuit diagram of the measurement target circuit. As illustrated in FIG. 9, an N-channel transistor 55 is provided as a measurement target circuit for each two adjacent semiconductor chips 50. For example, a 1st transistor 55 is provided for 1st and 2nd semiconductor chips 50, and a 2nd transistor 55 is provided for 2nd and 3rd semiconductor chips 50. Hereinafter, a semiconductor chip 50 with a smaller number of each two adjacent semiconductor chips 50 is referred to as a "left-hand semiconductor chip" and a semiconductor chip 50 with a greater number is referred to as a "right-hand semiconductor chip".

Two switches 56 and 57 are provided for each transistor 55. A source terminal (a terminal on the upper side in the case in FIG. 9) of the transistor 55 is grounded. A drain terminal of the transistor 55 is connected to one terminal (a terminal on the upper side in the case in FIG. 9) of each of the switches 56 and 57. A gate terminal of the transistor 55 is applied with a control signal CX. The other terminal of the switch 56 is connected to an external terminal 54 of the left-hand semiconductor chip 50. The other terminal of the switch 57 is connected to an external terminal 53 of the right-hand semiconductor chip 50.

Before operating the display apparatus 10, a current flowing through the transistor 55 is measured according to a procedure described below. First, the control signal CX is controlled to a particular level (a level that causes the transistor 55 to turn on), and the switch 56 is controlled to be in the on-state and the switch 57 is controlled to be in the off-state. In this situation, a current flows through the external terminal 54 of the left-hand semiconductor chip 50, the switch 56, and the transistor 55. The calibration output/measurement circuit 52 of the left-hand semiconductor chip 50 measures the current flowing in this situation. Next, while maintaining the control signal CX at the particular level, the switch 56 is controlled to be in the off-state and the switch 57 is controlled to be in the on-state. In this situation, a current flows through the external terminal 53 of the right-hand semiconductor chip 50, the switch 57, and the transistor 55. The calibration output/measurement circuit 51 of the right-hand semiconductor chip 50 measures the current flowing in this situation.

A result of current measurement performed by the calibration output/measurement circuits 51 and 52 is supplied from the data line drive/current measurement circuit 14 to the correction unit 16 in the display control circuit 12. The correction unit 16 determines, based on the current measurement result, the inter-chip correction data indicating the variation of the capacitance of the capacitor 32 among the semiconductor chip 50. The correction unit 16 writes the determined inter-chip correction data into the inter-chip correction data storage unit 15*e* in the correction data storage unit 15. When the correction unit 16 corrects the image signal VS1, correction unit 16 compensates for the variation of the capacitance of the capacitor 32 among the semiconductor chip 50 based on the inter-chip correction data stored in the inter-chip correction data storage unit 15*e*. As a result, it is possible to achieve high image quality in displaying.

Here, let it be assumed that the capacitance is equal for all capacitors 32 within one semiconductor chip 50. The calibration output/measurement circuit 52 of the left-hand semiconductor chip 50 and the calibration output/measurement circuit 51 of the right-hand semiconductor chip 50 measure currents flowing through the same transistor 55. Therefore, in a case where the capacitance of the capacitor 32 is equal for both the left-hand semiconductor chip 50 and the right-hand semiconductor chip 50, the result of the current measurement performed by the calibration output/measurement circuit 52 of the left-hand semiconductor chip 50 is equal to the result of the current measurement performed by the calibration output/measurement circuit 51 of the right-hand semiconductor chip 50. In a case where there is a difference between the two current measurement results, it is possible to determine, based on this difference, a difference between the capacitance of the capacitor 32 in the left-hand semiconductor chip 50 and the capacitance of the capacitor 32 in the right-hand semiconductor chip 50. By performing the process described above on the N semiconductor chips 50, it is possible to determine inter-chip correction data indicating the variation of the capacitance of the capacitor 32 among the semiconductor chips 50.

As described above, the display apparatus 10 according to the present embodiment includes the display unit 11 includes the plurality of scanning lines GA1 to GAn and GB1 to GBn, the plurality of data lines S1 to Sm, and the plurality of pixel circuits 20 arranged in the two-dimensional form, the scanning line drive circuit 13 configured to drive the scanning lines GA1 to GAn and GB1 to GBn, the data line drive circuit (a part of the data line drive/current measurement circuit 14) configured to drive the data lines S1 to Sm, the measurement circuit (the other part of the data line drive/current measurement circuit 14) including the plurality of measurement units (m channels) and configured to measure the current of the pixel circuit 20, the correction unit 16 configured to correct the image signal VS1 supplied to the data line drive circuit based on the current measured by the measurement circuit, and the storage unit (the correction data storage unit 15) configured to store the data used in correcting the image signal VS1. The plurality of measurement units are distributed among the plurality of semiconductor chips 50. The storage unit stores the inter-chip correction data indicating the variation of the characteristic of the element (the capacitance of the capacitor 32) in the measurement unit among the semiconductor chips 50. By storing the inter-chip correction data indicating the variation of the characteristic of the element in the measurement unit among the semiconductor chips 50 and correcting the image signal VS1 using the stored inter-chip correction data, it is possible to compensate for the variation of the characteristic of the element among the semiconductor chips 50 thereby achieving high image quality in displaying.

The inter-chip correction data is data based on the result of the current measurements performed, for the same measurement target circuit (the transistor 55), by the measurement units (the channels including the calibration output/measurement circuits 51 and 52) included in different semiconductor chips 50. The semiconductor chips 50 are arranged in a one-dimensional form, and the display apparatus 10 includes one measurement target circuit for two semiconductor chips. By measuring currents for measurement target circuits, it is possible to determine the inter-chip correction data.

The pixel circuit 20 includes the electro-optic element (the organic EL element 24), the driving transistor (the transistor 21) connected in series to the electro-optic element, the write control transistor (the transistor 22) including the first conduction terminal connected to the data line Sj, the second conduction terminal connected to the control terminal (the gate terminal) of the driving transistor, and the control terminal connected to the first scanning line GAi of the scanning lines, and the read control transistor (the transistor 23) including the first conduction terminal connected to the data line Sj, the second conduction terminal connected to the connection node between the driving transistor and the electro-optic element, and the control terminal connected to the second scanning line GBi of the scanning lines. Thus, in the display apparatus including the pixel circuits each including the electro-optic element, the driving transistor, the write control transistor, and the read control transistor, it is possible to compensate for the variation of the characteristic of the element among semiconductor chips 50 thereby achieving high image quality in displaying.

The storage unit stores the threshold voltages and the gains of the electro-optic element and the driving transistor for each pixel circuit 20. The correction unit 16 determines the threshold voltages and the gains to be stored based on the currents measured by the measurement circuit, and corrects the image signal VS1 based on the threshold voltages and the gains stored in the storage unit. Thus, by determining the threshold voltages and the gains of the electro-optic element and the driving transistor based on the result of the current measurements and correcting the image signal VS1 using these threshold voltages and the gains, it is possible to compensate for the variations or change of the characteristics of the electro-optic element and the driving transistor thereby achieving displaying with high image quality.

Second Embodiment

According to a second embodiment of the present invention, a display apparatus has the same configuration of that of the display apparatus according to the first embodiment and operates in a similar manner to the display apparatus according to the first embodiment (see FIGS. 1 to 6 and descriptions thereof). However, in the display apparatus according to the present embodiment, inter-chip correction data indicating a variation of capacitance of the capacitor 32 among the semiconductor chips 50 is determined by a method different from that used in the display apparatus according to the first embodiment. In the display apparatus according to the present embodiment, a cathode current of the organic EL element 24 is measured for each semiconductor chip 50. In the following description of embodiments, constituent elements similar to those in previous embodiments are denoted by similar reference symbols, and a further explanation thereof is omitted.

Figure 10:
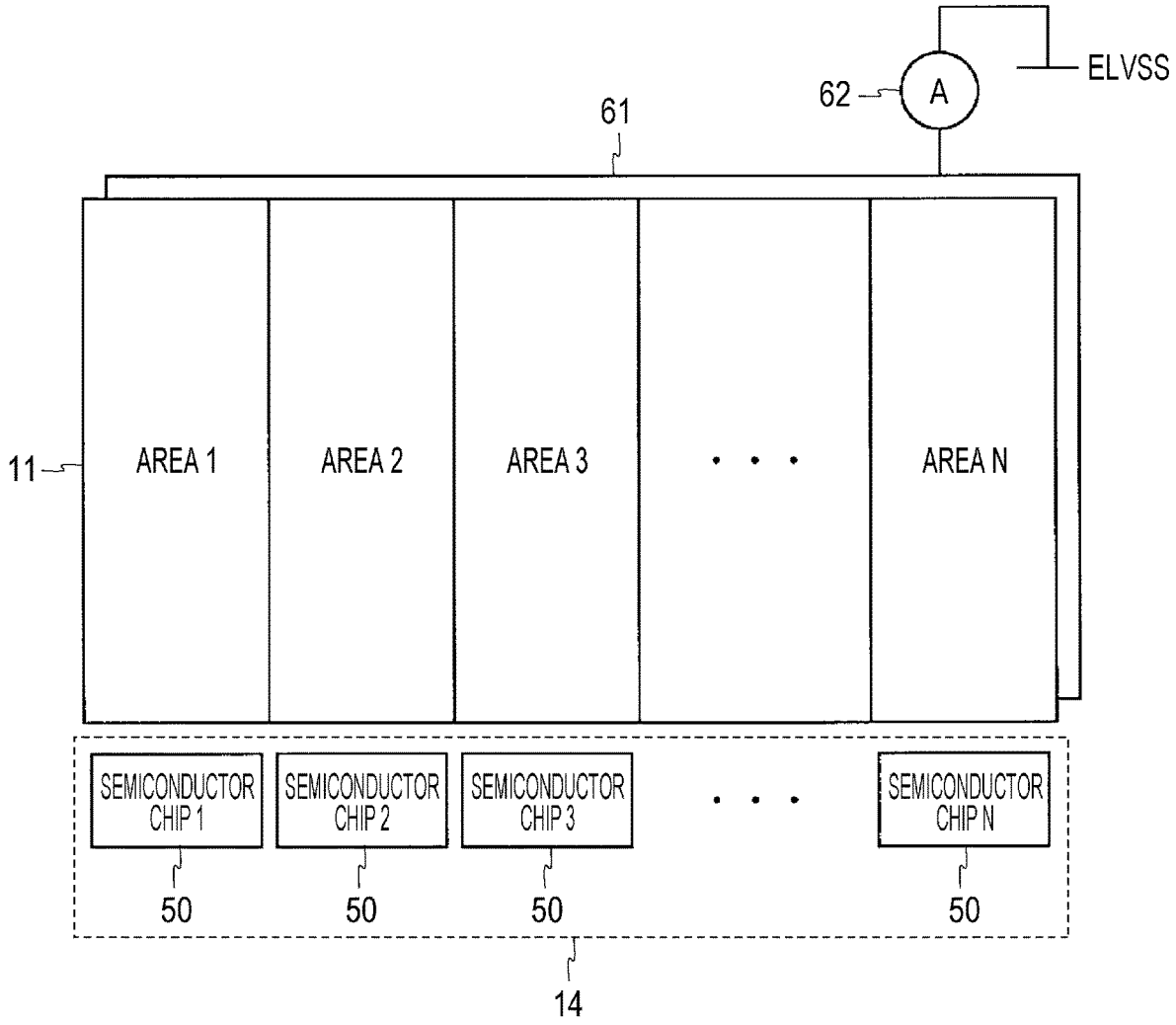
FIG. 10 is a diagram illustrating a method of measuring a cathode current of an organic EL element in a display apparatus according to a second embodiment of the present invention.

FIG. 10 is a diagram illustrating a method of measuring the cathode current of the organic EL element 24. As illustrated in FIG. 10, the display unit 11 includes a common cathode 61 connected to cathode terminals (not illustrated) of organic EL elements 24 in all pixel circuits 20. Before operating the display apparatus 10, a current detector 62 is connected to the common cathode 61 and a process illustrated in FIG. 11 is performed thereby determining inter-chip correction data.

Figure 11:
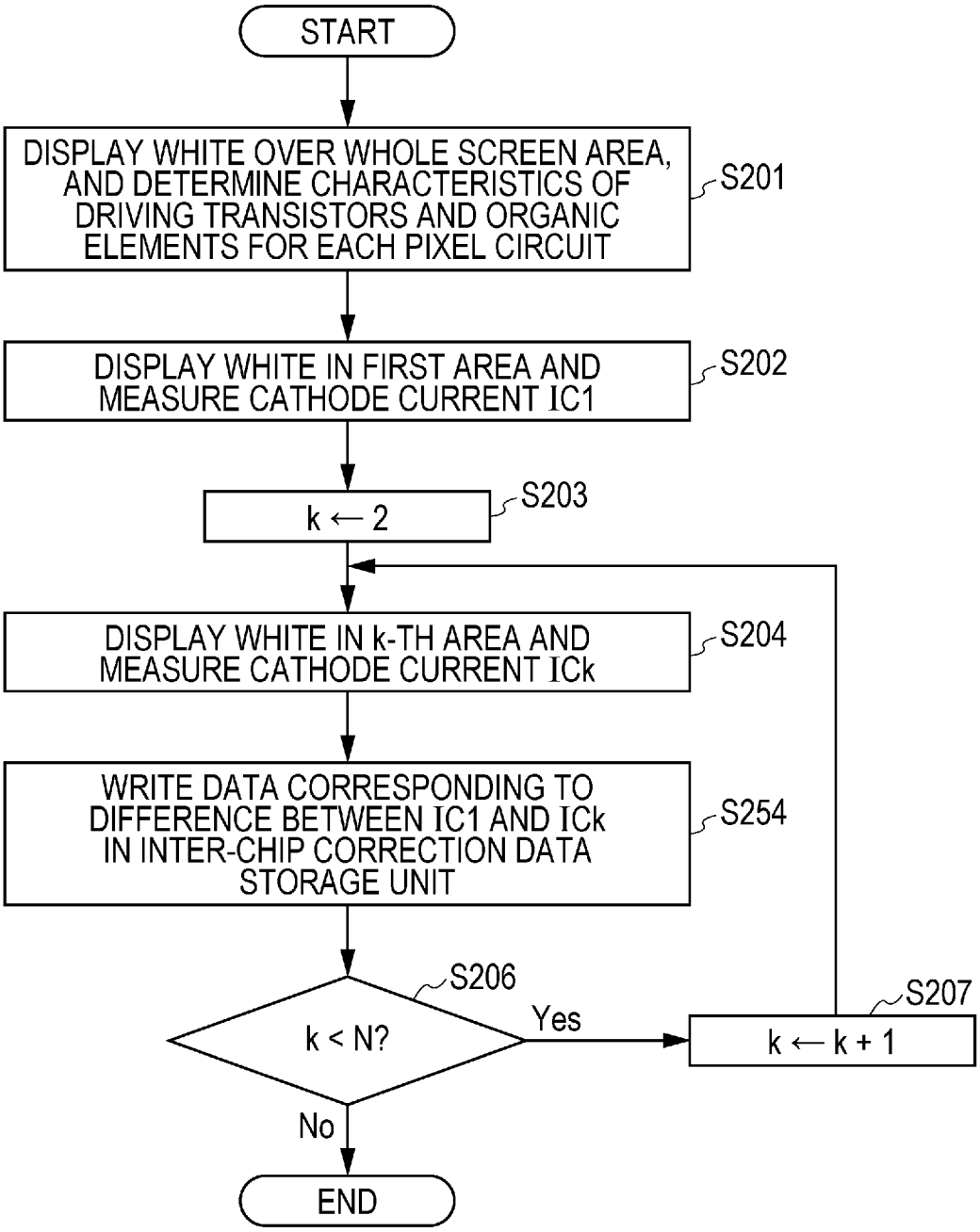
FIG. 11 is a flow chart illustrating a process of determining inter-chip correction data in the display apparatus according to the second embodiment.

FIG. 11 is a flow chart illustrating the process of determining the inter-chip correction data in the display apparatus according to the present embodiment. First, the display apparatus displays white over the entire screen area and determines the characteristics of the driving transistor and the organic EL element 24 for each pixel circuit 20 (step S201). In step S201, the scanning line drive circuit 13 supplies a selection voltage sequentially to the scanning lines GA1 to GAn. The data line drive/current measurement circuit 14 applies a voltage corresponding to maximum luminance to the data lines S1 to Sm. The correction unit 16 determines the threshold voltage and the gain of the transistor 21 and the threshold voltage and the gain of the organic EL element 24 for each pixel circuit 20.

Next, the display apparatus displays white in a 1st area and measures a cathode current IC1 of the organic EL element 24 flowing in this state (step S202). In step S202, the scanning line drive circuit 13 applies a selection voltage sequentially to the scanning lines GA1 to GAn. A 1st semiconductor chip 50 included in the data line drive/current measurement circuit 14 applies a voltage corresponding to maximum luminance to (m/N) data lines. The other (N−1) semiconductor chips 50 respectively apply voltages corresponding to minimum luminance to (m/N) data lines. Using the current detector 62, a cathode current IC1 of the organic EL element 24 flowing in this state is measured. Next, the display apparatus sets a variable k to 2 (step S203).

Next, the display apparatus displays white in a kth area and measures a cathode current ICk of the organic EL element 24 flowing in this state (step S204). In step S204, the scanning line drive circuit 13 supplies a selection voltage sequentially to the scanning lines GA1 to GAn. A kth semiconductor chip 50 included in the data line drive/current measurement circuit 14 applies a voltage corresponding to maximum luminance to (m/N) data lines. The other (N−1) semiconductor chips 50 respectively apply voltages corresponding to minimum luminance to (m/N) data lines. Using the current detector 62, a cathode current ICk of the organic EL element 24 flowing in this state is measured.

Next, the display apparatus determines the difference between the cathode current IC1 measured in step S202 and the cathode current ICk measured in step S204, and writes data corresponding to the determined difference into the inter-chip correction data storage unit 15*e* in the correction data storage unit 15 (step S205).

Next, the display apparatus determines whether k is smaller than N (step S206). In a case where the determination result in step S206 is Yes, the display apparatus adds 1 to the variable k (step S207), and proceeds to step S204. In a case where the determination result in step S206 is No, the display apparatus end the process.

In the display apparatus according to the present embodiment, the process illustrated in FIG. 11 may be performed once after the production of the display apparatus is completed. In the display apparatus according to the present embodiment, in the correction data storage unit 15, at least the inter-chip correction data storage unit 15*e* is formed by a non-volatile memory.

In the display apparatus according to the present embodiment, as with the display apparatus 10 according to the first embodiment, it is possible to compensate for the variation of the capacitance of the capacitor 32 among the semiconductor chips 50 thereby achieving high image quality in displaying.

Note that in the present embodiment, the display apparatus determines the inter-chip correction data based on the difference between the cathode current IC1 and the cathode current ICk. Alternatively, the display apparatus may determine the inter-chip correction data based on the difference between a cathode current ICq measured for a qth semiconductor chip 50 and the cathode current ICk where q is an arbitrary integer in a range from 2 (inclusive) to N (inclusive).

As described above, in the display apparatus according to the present embodiment, the pixel circuit 20 includes the electro-optic element (the organic EL element 24) including the common cathode 61. The inter-chip correction data is data based on a result of measurement of the current flowing through the common cathode 61 for each semiconductor chip 50. In particular, the inter-chip correction data is data based a result of measurement performed such that the display unit 11 is divided into a plurality of areas corresponding to the semiconductor chips 50, and the areas are controlled to be sequentially in a light emission state, and the current flowing through the common cathode 61 is measured. By measuring the current flowing through the common cathode 61, it is possible to determine the inter-chip correction data. By storing the determined inter-chip correction data and correcting the image signal VS1 using the stored inter-chip correction data, it is possible to compensate for the variation of the characteristic of the element among the semiconductor chips 50 thereby achieving high image quality in displaying.

Third Embodiment

Figure 12:
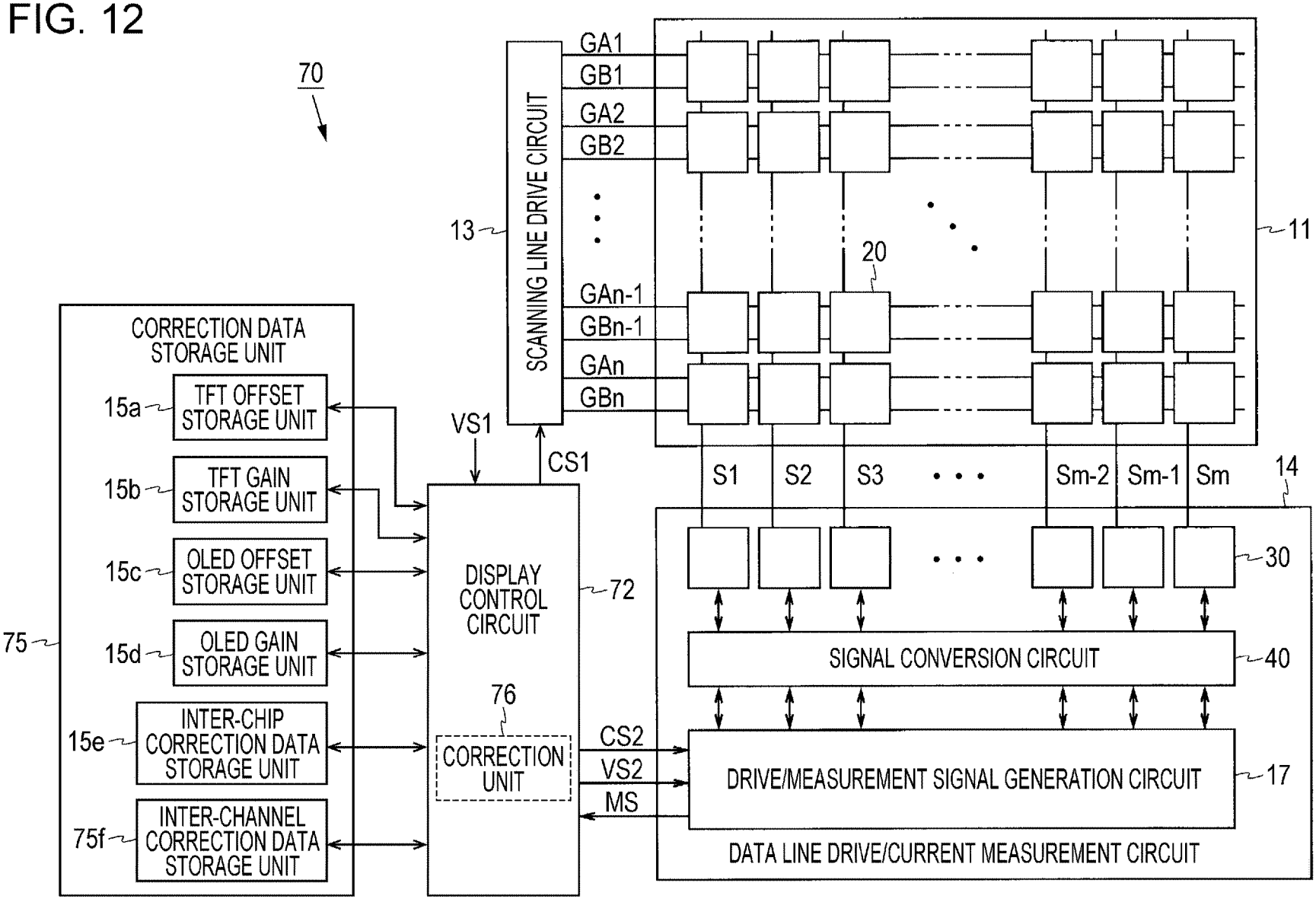
FIG. 12 is a block diagram illustrating a configuration of a display apparatus according to a third embodiment of the present invention.

FIG. 12 a block diagram illustrating a configuration of a display apparatus according to a third embodiment of the present invention. The display apparatus 70 illustrated in FIG. 12 is different in configuration from the display apparatus 10 (FIG. 1) according to the first embodiment in that the display control circuit 12 and the correction data storage unit 15 are respectively replaced by a display control circuit 72 and a correction data storage unit 75. The display control circuit 72 includes a correction unit 76 instead of the correction unit 16. The correction data storage unit 75 includes an inter-channel correction data storage unit 75*f* in addition to elements of the correction data storage unit 15. The display apparatus 70 measures a zero-current for each channel and determines inter-channel correction data indicating a variation of capacitance of the capacitor 32 among the channels.

Figure 13:
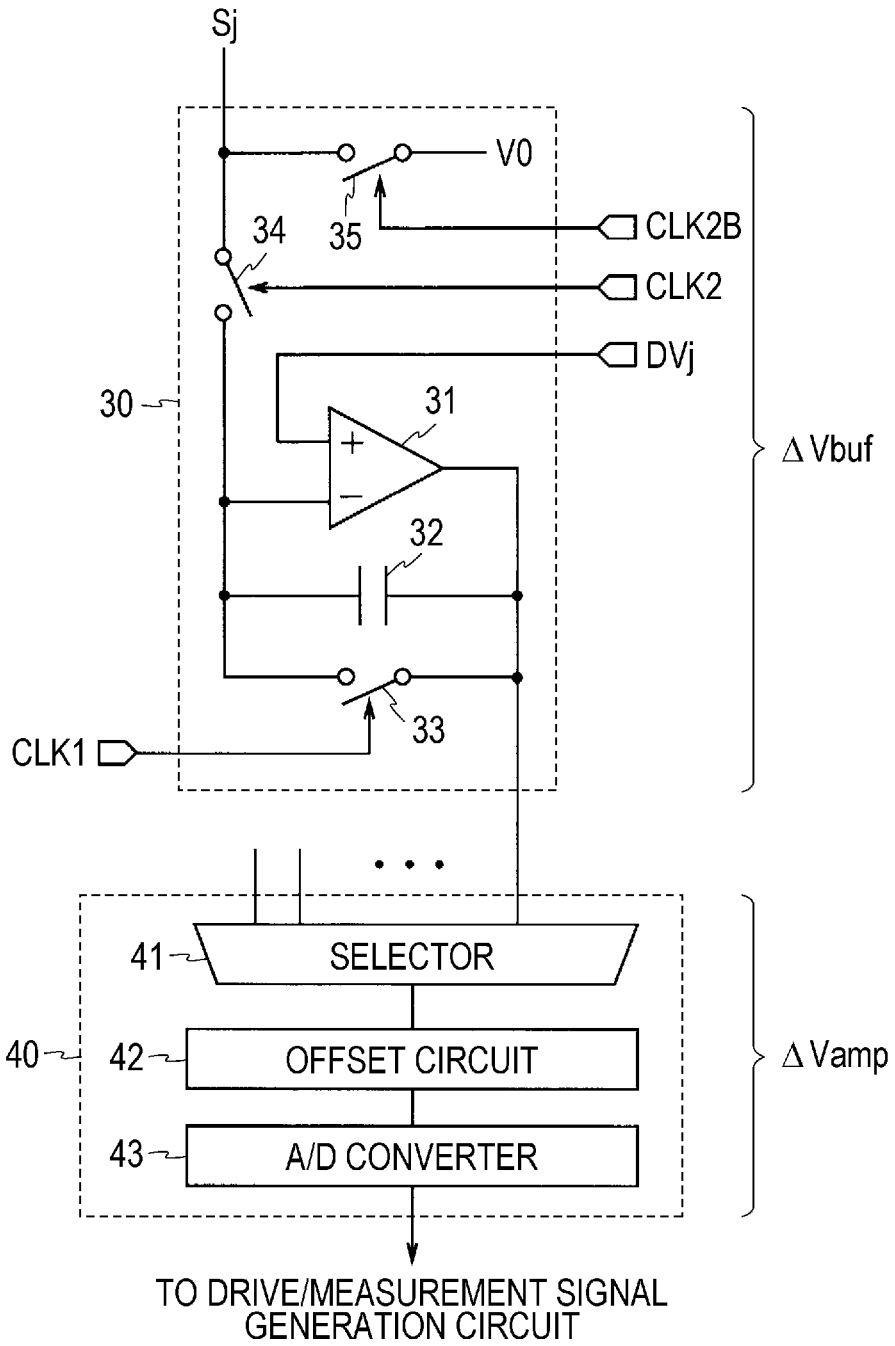
FIG. 13 is a diagram illustrating a channel included in the display apparatus illustrated in FIG. 12 and also illustrating an offset voltage of the channel.

FIG. 13 is a diagram illustrating a channel included in the data line drive/current measurement circuit 14 and an offset voltage of the channel. As illustrated in FIG. 13, the channel includes one output/measurement circuit 30 and one signal conversion circuit 40. Hereinafter, an offset voltage of the output/measurement circuit 30 is denoted by ΔVbuf, and an offset voltage of the signal conversion circuit 40 is denoted by ΔVamp.

Before operating the display apparatus 70, the zero-current is measured according to a procedure described below. The display control circuit 72 outputs zero-current measurement command, as control signals CS1 and CS2, to the scanning line drive circuit 13 and the data line drive/current measurement circuit 14. When the scanning line drive circuit 13 receives the zero-current measurement command, the scanning line drive circuit 13 applies a non-select voltage (at the low level in this case) to the scanning lines GA1 to GAn and GB1 to GBn. When the data line drive/current measurement circuit 14 receives the zero-current measurement command, the data line drive/current measurement circuit 14 applies a zero-voltage to the data lines S1 to Sm by using m output/measurement circuits 30. The (m/p) selectors 41 included in the data line drive/current measurement circuit 14 sequentially select output signals of the p operational amplifier 31. When the selectors 41 have completed the selection p times, a total of m digital values (hereinafter, referred to as zero-current values) are stored in the drive/measurement signal generation circuit 17. The drive/measurement signal generation circuit 17 outputs monitor signals MS including m zero-current values to the display control circuit 72.

The m zero-current values are supplied from the data line drive/current measurement circuit 14 to the correction unit 76 in the display control circuit 72. The correction unit 76 determines m offset voltages (ΔVbuf+ΔVamp) based on the m zero-current values, and writes the determined offset voltage, as inter-channel correction data, into the inter-channel correction data storage unit 75*f*. When the correction unit 76 corrects the image signal VS1, the correction unit 76 performs a process, based on the inter-chip correction data stored in the inter-chip correction data storage unit 15*e*, to compensate for the variation of the characteristic of the element among the semiconductor chips 50, and the correction unit 76 also performs a process, based on the inter-channel correction data stored in the inter-channel correction data storage unit 75*f*, to compensate for the variation of the characteristic of the element among the channels.

As described above with reference to FIG. 4, in the operation of detecting the driving transistor characteristic, the gate terminal of the transistor 21 is applied with the reference voltage Vref_TFT, and the source terminal of the transistor 21 is applied with the measurement voltage Vm_TFT (one of the first and second measurement voltages Vm1 and Vm2). When the offset voltage ΔVbuf of the output/measurement circuit 30 is taken into account, the voltage applied to the gate terminal of the transistor 21 is given by (Vre_fTFT+ΔVbuf), and the voltage applied to the source terminal of the transistor 21 is given by (Vm_TFT+ΔVbuf). In the operation of detecting the driving transistor characteristic, a current flows through the transistor 21 depending on the gate-to-source voltage. Therefore, in the operation of detecting the driving transistor characteristic, a current flows depending on the voltage {(Vref_TFT+ΔVbuf)−(Vm_TFT+ΔVbuf)}=(Vref_TFT−Vm_TFT). The current which flows in this situation does not depend on the offset voltage ΔVbuf of the output/measurement circuit 30.

Furthermore, as described above with reference to FIG. 5, in the operation of detecting the organic EL element characteristic, the anode terminal of the organic EL element 24 (the source terminal of the transistor 21) is applied with the measurement voltage Vm_OLED (one of the third and fourth measurement voltages Vm3 and Vm4). When the offset voltage ΔVbuf of the output/measurement circuit 30 is taken into account, the voltage applied to the anode terminal of the organic EL element 24 is given by (Vm_OLED+ΔVbuf). The cathode terminal of the organic EL element 24 is applied with a constant voltage equal to the low-level power supply voltage ELVSS. In the operation of detecting the organic EL element characteristic, a current flows through the organic EL element 24 depending on the anode-to-cathode voltage. Therefore, in the operation of detecting the organic EL element characteristic, a current flows depending on the voltage (Vm_OLED+ΔVbuf). The current which flows in this situation depends on the offset voltage ΔVbuf of the output/measurement circuit 30.

In the operation of detecting the driving transistor characteristic and also in the operation of detecting the organic EL element characteristic, the offset voltage (ΔVbuf+ΔVamp) is added to the output signal of the signal conversion circuit 40. Based on the inter-channel correction data stored in the inter-channel correction data storage unit 75*f*, the correction unit 76 cancels out the offset voltage (ΔVbuf+ΔVamp) included in the output signal of the signal conversion circuit 40. Thus, the correction unit 76 is capable of determining the true current value in the operation of detecting the driving transistor characteristic. In the operation of detecting the organic EL element characteristic, the correction unit 76 determines a current value which is greater than the true current value by an amount corresponding to the ΔVbuf.

Based on the true current value determined in the operation of detecting the driving transistor characteristic, the correction unit 76 determines the true value of the threshold voltage of the driving transistor. The determined threshold voltage of the driving transistor is stored in the TFT offset storage unit 15*a*. Based on the current value, determined in the operation of detecting the organic EL element characteristic, which is greater than the true value by the amount corresponding to the ΔVbuf, the correction unit 76 determines a voltage, as a threshold voltage of the organic EL element, which is smaller than the true value by ΔVbuf. The determined threshold value of the organic EL element is stored in the OLED offset storage unit 15*c*.

The correction unit 76 performs the correction process illustrated in FIG. 6 as with the correction unit 16 according to the first embodiment. In step S103, the correction unit 76 determines a corrected voltage value $Vdata2_{TFT}$ based on the true value of the threshold voltage of the driving transistor. In step S104, based on the threshold voltage of the organic EL element smaller than the true value by ΔVbuf, the correction unit 76 determines a corrected voltage value $Vdata2_{OLED}$ smaller by ΔVbuf than a value determined without taking into account the offset voltage. In step S105, the correction unit 76 adds the corrected voltage value $Vdata2_{TFT}$ determined in step S103 and the corrected voltage value $Vdata2_{OLED}$ determined in step S104. Therefore, the output code value CV determined in step S106 is smaller, by an amount corresponding to ΔVbuf, than a value determined without taking into account the offset voltage.

The output/measurement circuit 30 has an offset voltage of ΔVbuf, and thus when the data line Sj is driven based on the output code value CV, the data line Sj is applied with a voltage equal to the voltage corresponding to the output code value CV (the voltage smaller by ΔVbuf than a value determined without taking into account the offset voltage) plus ΔVbuf. Therefore, ΔVbuf is cancelled out in the voltage applied to the data line Sj.

As described above, in the display apparatus 70 according to the present embodiment, the storage unit (correction data storage unit 75) stores the inter-channel correction data indicating the variation of the element in the measurement unit among the measurement units (channels). By storing the inter-channel correction data and correcting the image signal VS1 using the stored inter-channel correction data, it is possible to compensate for the variation of the characteristic of the element among the measurement units thereby achieving still higher image quality in displaying. The inter-channel correction data is data based on the result of measuring the zero-current by using the correction unit. By measuring the zero-current for each channel, it is possible to determine the inter-channel correction data.

In the above description, it is assumed that the display apparatus 70 according to the third embodiment is configured based on the display apparatus 10 according to the first embodiment. Alternatively, the display apparatus may be configured based on the display apparatus according to the second embodiment. In this alternative display apparatus, it is possible to achieve effects similar to those achieved by the display apparatus according to the third embodiment.

Fourth Embodiment

In the first to third embodiments described above, the display apparatus includes a current measurement circuit configured to measure a current of a pixel circuit. In a fourth embodiment described below, the display apparatus includes a voltage measurement circuit configured to measure a voltage of a pixel circuit.

Figure 14:
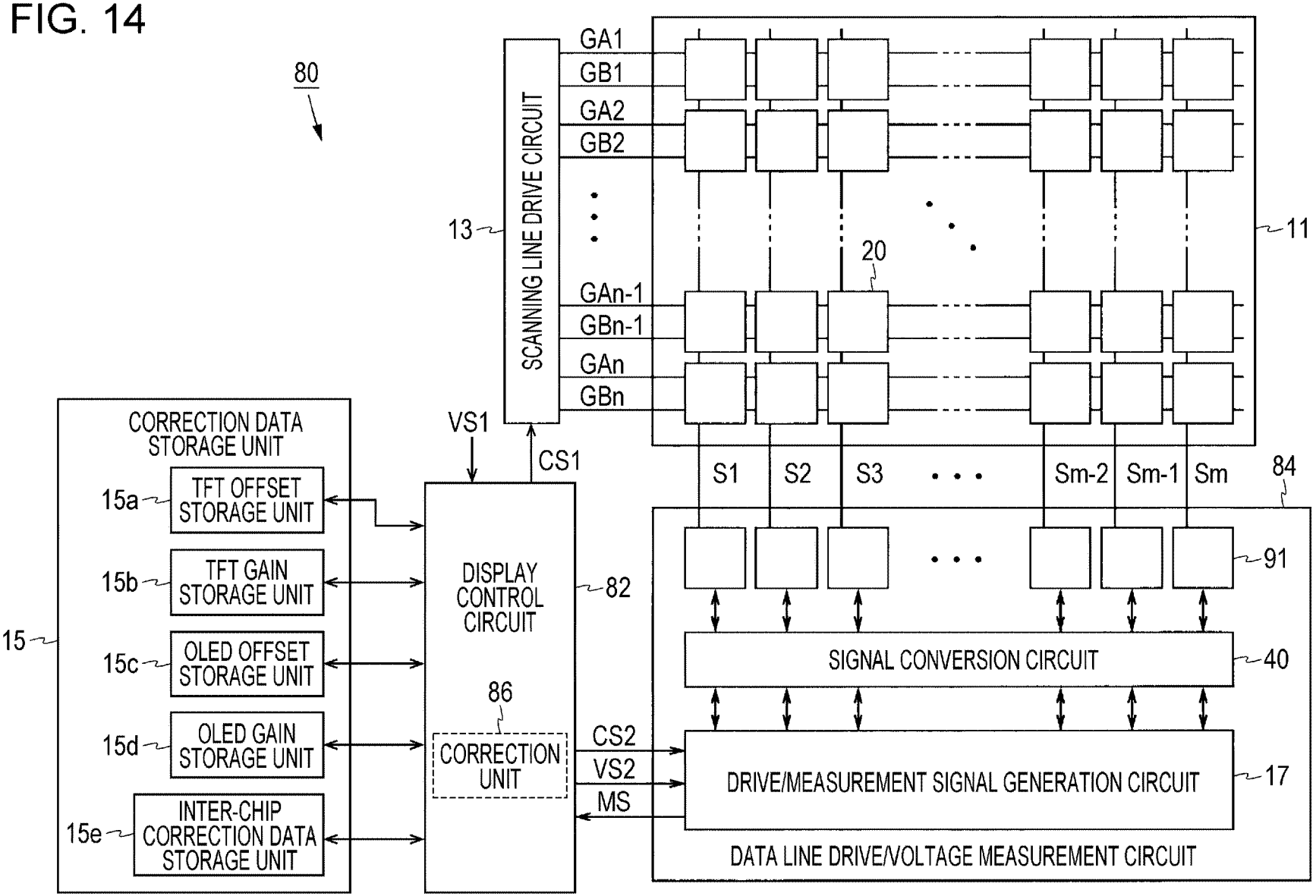
FIG. 14 is a block diagram illustrating a configuration of a display apparatus according to a fourth embodiment of the present invention.

FIG. 14 is a block diagram illustrating a configuration of the display apparatus according to the fourth embodiment of the present invention. The display apparatus 80 illustrated in FIG. 14 has a configuration obtained by modifying the configuration of the display apparatus 10 (FIG. 1) according to the first embodiment such that the display control circuit 12 and the data line drive/current measurement circuit 14 are respectively replaced by a display control circuit 82 and a data line drive/voltage measurement circuit (a circuit functioning as both a data line drive circuit and voltage measurement circuit) 84. The display control circuit 82 includes a correction unit 86 instead of the correction unit 16. The data line drive/voltage measurement circuit 84 includes a drive/measurement signal generation circuit 17, a signal conversion circuit 40, and m output/measurement circuits 91.

Figure 15:
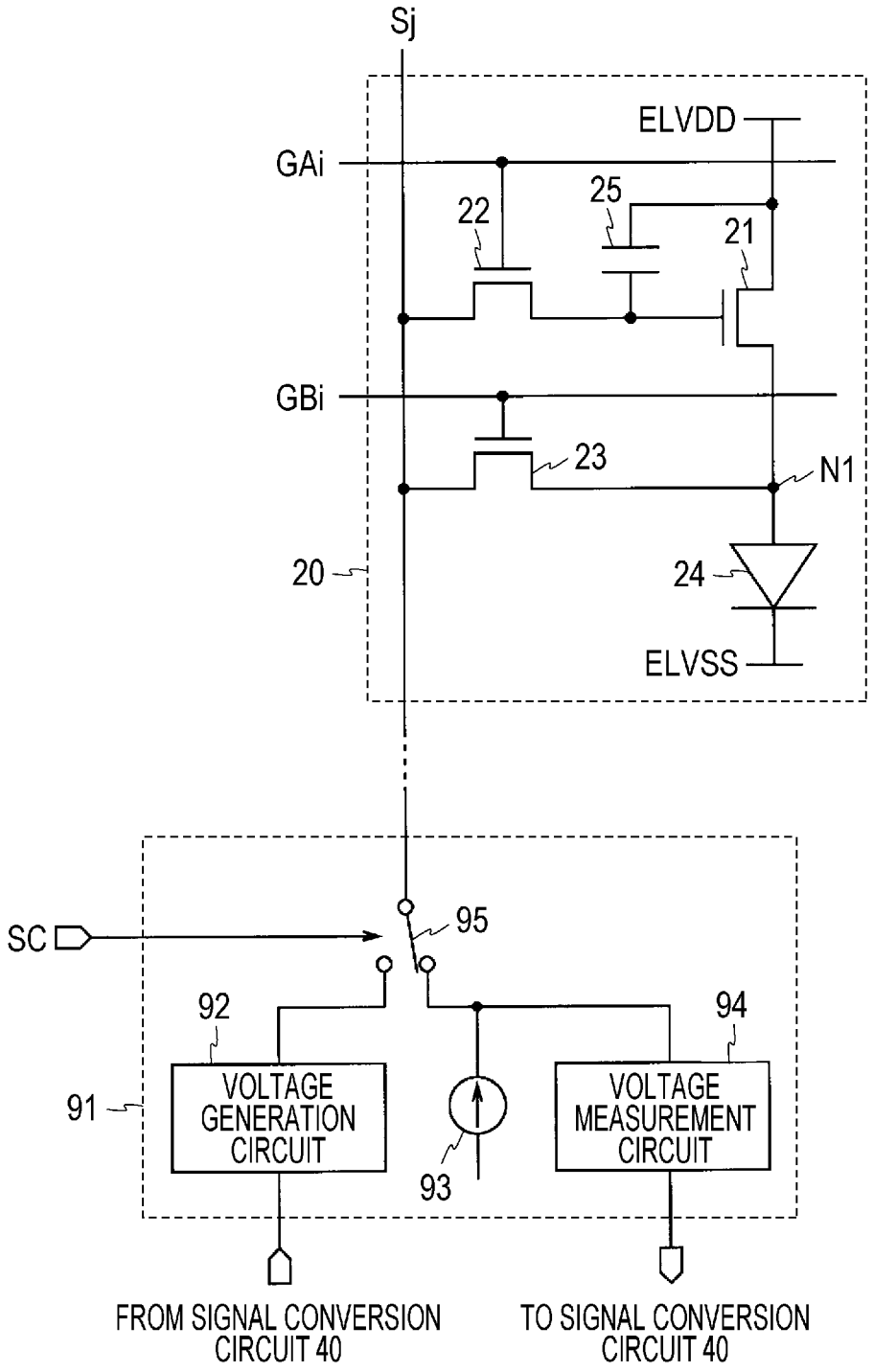
FIG. 15 is a diagram illustrating a configuration of a pixel circuit and an output/measurement circuit of the display apparatus illustrated in FIG. 14.

FIG. 15 is a diagram illustrating a configuration of the pixel circuit 20 and the output/measurement circuit 91. In FIG. 15, a pixel circuit 20 located in an ith row and a jth column and an output/measurement circuit 91 corresponding to a data line Sj are shown. Hereinafter, a node at which the source terminal of the transistor 21 and the anode terminal of the organic EL element 24 are connected to each other is referred to as N1.

The output/measurement circuit 91 includes a voltage generation circuit 92, a current source 93, a voltage measurement circuit 94, and a switch 95. One end of the switch 95 is connected to the data line Sj. The switch 95 switches the connection state according to a switch control signal SC between a state in which the data line Sj is connected to the voltage generation circuit 92 and a state in which the data line Sj is connected to the current source 93 and the voltage measurement circuit 94.

The voltage generation circuit 92 outputs a data voltage or a reference voltage according to digital data output from the signal conversion circuit 40. In the state in which the data line Sj is connected to the voltage generation circuit 92, the data voltage or the reference voltage output from the voltage generation circuit 92 is applied to the data line Sj. In the state in which the data line Sj is connected to the current source 93 and the voltage measurement circuit 94, the current source 93 provides a particular current flowing into the data line Sj, and the voltage measurement circuit 94 measure a voltage on the data line Sj in this state.

To obtain the image signal VS2 by correcting the image signal VS1, the data line drive/voltage measurement circuit 84 measures four kinds of voltages for each pixel circuit 20. More specifically, to determine the characteristic of the transistor 21 in each pixel circuit 20, the data line drive/voltage measurement circuit 84 measures a voltage Vn1 at the node N1 in a state in which a reference voltage is written into the pixel circuit 20 such that the transistor 21 turns on, and a first measurement current In1 is passed into the pixel circuit 20 from the current source 93, and the data line drive/voltage measurement circuit 84 measures a voltage Vn2 at the node N1 in a state in which a voltage is written into the pixel circuit 20 such that the transistor 21 and a second measurement current In1 (>In1) is passed into the pixel circuit 20 from the current source 93. Furthermore, to determine the characteristic of the organic EL element 24 in each pixel circuit 20, the data line drive/voltage measurement circuit 84 measures a voltage Vn3 at the node N1 in a state in which a voltage is written into the pixel circuit 20 such that the transistor 21 turns off and a third measurement current In3 is passed into the current source 93 from the pixel circuit 20, and the data line drive/voltage measurement circuit 84 measures a voltage Vn4 at the node N1 in a state in which a voltage is written into the pixel circuit 20 such that the transistor 21 turns off and a fourth measurement current In4 (>In3) is passed into the current source 93 from the pixel circuit 20.

The scanning line drive circuit 13 and the data line drive/voltage measurement circuit 84 perform writing into one row of pixel circuits 20 and measure one of the four kinds of voltages Vn1 to Vn4 for one row of pixel circuits 20. For example, the scanning line drive circuit 13 and the data line drive/voltage measurement circuit 84 may perform the process such that in four successive frame periods, voltages Vn1 to Vn4 are measured for pixel circuits 20 in an ith row in an ith line period in respective first to fourth frame periods, and writing into one row of pixel circuits 20 is performed in the other line periods.

The correction unit 86 performs a process of determining the characteristic of the transistor 21 and the organic EL element 24 based on the measured four kinds of voltages Vn1 to Vn4, and corrects the image signal VS1 based on the determined two kinds of characteristics. More specifically, the correction unit 86 determines the threshold voltage and the gain of the transistor 21 as the characteristics thereof based on the two kinds of voltages Vn1 and Vn2, and determines the threshold voltage and the gain of the organic EL element 24 as the characteristics thereof based on the two kinds of voltages Vn3 and Vn4. The correction unit 86 writes the determined threshold voltages and gains into the correction data storage unit 15 and corrects the image signal VS1 using the threshold voltages and gains read out from the correction data storage unit 15.

As with the first embodiment, the data line drive/voltage measurement circuit 84 is configured using N semiconductor chips. In the data line drive/voltage measurement circuit, m channels (each of which is a part configured to determine one digital value based on a voltage on one data line) are distributed among the N semiconductor chips. The display apparatus 80 determines inter-chip correction data using the method described in the first embodiment or the method described in the second embodiment. The determined inter-chip correction data is stored in the inter-chip correction data storage unit 15*e* of the correction data storage unit 15. The correction unit 86 compensates for the variation of the capacitance of the capacitor 32 among the semiconductor chips 50 based on the inter-chip correction data stored in the inter-chip correction data storage unit 15*e*. As a result, it is possible to achieve high image quality in displaying.

As described above, in the display apparatus 80 according to the present embodiment, the measurement circuit (the other part of the data line drive/voltage measurement circuit 84) includes a plurality of measurement units (m channels) and measure voltages of the pixel circuits 20. Also in the display apparatus 80 according to the present embodiment, the inter-chip correction data indicating the variation of the characteristic of the element in the measurement unit among the semiconductor chips is stored, and the image signal VS1 is corrected using the stored inter-chip correction data, and thereby it is possible to compensate for the variation of the characteristic of the element among semiconductor chips, which makes it possible to achieve high image quality in displaying.

In the display apparatuses according to the respective embodiments described above, it is assumed that each display apparatus includes pixel circuits 20. However, the display apparatus according to the present invention may include another pixel circuit. Furthermore, the display apparatuses according to the respective embodiments described above each include the output/measurement circuit 30 or the output/measurement circuit 91. However, the display apparatus according to the present invention may include another output/measurement circuit. Note that features of the display apparatuses according to the respective embodiments described above and modifications thereof may be arbitrarily combined as long as no conflicts occur to realize a display apparatus having a plurality of features of the embodiments and the modifications.

The transistors included in the display apparatus described above may be an oxide semiconductor transistor including an oxide semiconductor film. The oxide semiconductor film may include, for example, at least one of the following metal elements: In (indium); Ga (gallium); and Zn (zinc). In particular, the oxide semiconductor film may include an In—Ga—Zn—O based semiconductor. The In—Ga—Zn—O based semiconductor is a ternary oxide of In, Ga, and Zn. There is no particular restriction on the ratio (composition ratio) among In, Ga, and Zn. For example, the ratio may be In:Ga:Zn=2:2:1, In:Ga:Zn=1:1:1, In:Ga:Zn=1:1:2, etc. Such an oxide semiconductor film may be formed from an oxide semiconductor film including an In—Ga—Zn—O based semiconductor. Note that a channel etch type TFT having an active layer including an In—Ga—Zn—O based semiconductor is also called "CE-InGaZnO-TFT". The In—Ga—Zn—O based semiconductor may be amorphous or crystalline. A preferable example of a crystalline In—Ga—Zn—O based on semiconductor is a crystalline In—Ga—Zn—O based on semiconductor whose c axis is oriented substantially perpendicular to a layer plane.

INDUSTRIAL APPLICABILITY

The display apparatus according to the present invention has a feature that it is possible to compensate for a variation of a characteristic of an element among semiconductor chips or among measurement units and thus it is possible to achieve high image quality in displaying. The display apparatus according to the present invention can be used in a wide variety of display apparatuses such as an organic EL display apparatus.

REFERENCE SIGNS LIST

10, 70, 80 display apparatus
11 display unit
12, 72, 82 display control circuit
13 scanning line drive circuit
14 data line drive/current measurement circuit

15, 75 correction data storage unit
16, 76, 86 correction unit
17 drive/measurement signal generation circuit
20 pixel circuit
21 transistor (driving transistor)
22 transistor (write control transistor)
23 transistor (read control transistor)
24 organic EL element (electro-optic element)
25, 32 capacitor
30, 91 output/measurement circuit
31 operational amplifier
33 to 35, 56 to 57, 95 switch
40 signal conversion circuit
41 selector
42 offset circuit
43 A/D converter
50 semiconductor chip
51, 52 calibration output/measurement circuit
53, 54 external terminal
55 transistor (measurement target circuit)
61 cathode
62 current detector
84 data line drive/voltage measurement circuit
92 voltage generation circuit
93 current source
94 voltage measurement circuit
GA1 to GAn, GB1 to GBn scanning line
S1 to Sm data line

The invention claimed is:

1. An active matrix display apparatus comprising:
a display including a plurality of scanning lines, a plurality of data lines, and a plurality of pixel circuits arranged in two dimensions;
a scanning line drive circuit that drives the plurality of scanning lines;
a data line drive circuit that drives the plurality of data lines;
a measurement circuit including a plurality of measurement units and that measures currents or voltages of the plurality of pixel circuits;
a correction circuit that corrects, based on currents or voltages measured by the measurement circuit, an image signal to be supplied to the data line drive circuit; and
a memory that stores data used in correcting the image signal; wherein
the plurality of measurement units are in a plurality of semiconductor chips such that the plurality of measurement units are distributed among the plurality of semiconductor chips,
the memory stores inter-chip correction data indicating a variation in terms of a characteristic of an element in measurement units other than the plurality of measurement units among the plurality of semiconductor chips,
two adjacent semiconductor chips among the plurality of semiconductor chips share a measurement target circuit, and
the inter-chip correction data is data based on a result of a measurement of a current or a voltage being performed on the measurement target circuit using the measurement units other than the plurality of measurement units in the two adjacent semiconductor chips.

2. The display apparatus according to claim 1, wherein the plurality of semiconductor chips are arranged in one dimension.

3. The display apparatus according to claim 1, wherein a number of the measurement target circuits is smaller by one than a number of the plurality of semiconductor chips.

4. The display apparatus according to claim 1, wherein each of the plurality of pixel circuits includes an electro-optic element and a driving transistor connected in series to the electro-optic element.

5. The display apparatus according to claim 4, wherein
the memory further stores threshold voltages and gains of the electro-optic element and the driving transistor for each of the plurality of pixel circuits, and
the correction circuit determines, based on the currents or the voltages measured by the measurement circuit, the threshold voltages and the gains to be stored in the memory and corrects the image signal based on the threshold voltages and the gains stored in the storage.

6. The display apparatus according to claim 5, wherein each of the plurality of pixel circuits further includes:
a write control transistor including a first conduction terminal connected to one of the plurality of data lines, a second conduction terminal of a control terminal of the driving transistor, and a control terminal connected to a first scanning line of the plurality of scanning lines, and
a read control transistor including a first conduction terminal connected to one of the plurality of data lines, a second conduction terminal connected to a connection node between the driving transistor and the electro-optic element, and a control terminal connected to a second scanning line of the plurality of scanning lines.

7. The display apparatus according to claim 1, wherein
the measurement target circuit includes a transistor, and
a conduction terminal of the transistor is connected to an external terminal of the two adjacent semiconductor chips via a corresponding switch.

8. The display apparatus according to claim 7, further comprising:
a plurality of measurement circuits; and
a plurality of measurement target circuits including the measurement target circuit, wherein
the plurality of measurement circuits are provided in each of the plurality of the semiconductor chips, respectively,
a first measurement circuit of the plurality of measurement circuits is connected to a corresponding one of the plurality of data lines,
a second measurement circuit of the plurality of measurement circuits is connected to a first measurement target circuit of the plurality of measurement target circuits, the first measurement target circuit being shared by a first semiconductor chip and a second semiconductor chip that is adjacent to the first semiconductor chip, and
a third measurement circuit of the plurality of measurement circuits is connected to a second measurement target circuit of the plurality of measurement target circuits, the third measurement target circuit being shared by the first semiconductor chip and a third semiconductor chip that is adjacent to the first specific semiconductor chip.

9. The display apparatus according to claim 8, wherein transistors of the plurality of measurement target circuits share a control signal.

10. A method of driving a display apparatus, the display apparatus being an active matrix display apparatus including a display including a plurality of scanning lines, a plurality of data lines, and a plurality of pixel circuits arranged in two dimensions, the method comprising:

driving the plurality of scanning lines;

driving the plurality of data lines;

measuring currents or voltages of the plurality of pixel circuits by using a plurality of measurement units;

correcting, based on measured currents or voltages, an image signal used to drive the plurality of data lines; and storing data used in correcting the image signal, wherein the plurality of measurement units are in a plurality of semiconductor chips such that the plurality of measurement units are distributed among the plurality of semiconductor chips, in the storing, inter-chip correction data indicating a variation of a characteristic of an element in measurement units other than the plurality of measurement units among the plurality of semiconductor chips is stored, two adjacent semiconductor chips among the plurality of semiconductor chips share a measurement target circuit, and the inter-chip correction data is data based on a result of a measurement of a current or a voltage being performed on the measurement target circuit using the measurement units other than the plurality of measurement units in the two adjacent semiconductor chips.

* * * * *